US012029288B2

(12) United States Patent
Rihn et al.

(10) Patent No.: US 12,029,288 B2
(45) Date of Patent: Jul. 9, 2024

(54) WIND RESISTANT PARASOL

(71) Applicant: Jeffrey Rihn, Wayne, PA (US)

(72) Inventors: Jeffrey Rihn, Wayne, PA (US); Ahmed Mohammed Naguib Allam, Luxor (EG)

(73) Assignee: Jeffrey Rihn, Wayne, PA (US)

( * ) Notice: Subject to any disclaimer, the term of this patent is extended or adjusted under 35 U.S.C. 154(b) by 170 days.

(21) Appl. No.: 17/805,808

(22) Filed: Jun. 7, 2022

(65) Prior Publication Data

US 2023/0389667 A1 Dec. 7, 2023

(51) Int. Cl.

| | |
|---|---|
| ***A45B 25/22*** | (2006.01) |
| ***A45B 17/00*** | (2006.01) |
| ***A45B 19/04*** | (2006.01) |
| ***A45B 25/02*** | (2006.01) |

(52) U.S. Cl.

CPC ..... *A45B 25/22* (2013.01); *A45B 17/00* (2013.01); *A45B 19/04* (2013.01); *A45B 25/02* (2013.01)

(58) Field of Classification Search

CPC ..... A45B 25/22; A45B 2011/005
USPC ..... 135/29
See application file for complete search history.

(56) References Cited

U.S. PATENT DOCUMENTS

| | | | | |
|---|---|---|---|---|
| 4,978,110 A * | 12/1990 | Lin | A45B 25/18 | 182/47 |
| 5,487,401 A | 1/1996 | Johnson et al. | | |
| 5,555,903 A * | 9/1996 | Rizzotti | A45B 11/00 | 135/20.1 |
| 5,601,103 A * | 2/1997 | Dubinsky | A45B 25/22 | 135/33.7 |
| 5,640,984 A * | 6/1997 | Dubunsky | A45B 25/02 | 135/33.7 |
| 5,642,747 A * | 7/1997 | Rizzotti | A45B 11/00 | 135/20.1 |
| 6,186,157 B1 | 2/2001 | Lin et al. | | |
| 6,206,017 B1 | 3/2001 | Johnson et al. | | |
| 6,336,464 B1 | 1/2002 | Ko | | |
| D459,871 S | 7/2002 | Persson | | |
| 6,571,814 B2 | 6/2003 | You | | |
| D516,294 S | 3/2006 | Olson et al. | | |
| 7,946,305 B1 | 5/2011 | Mailman | | |

(Continued)

FOREIGN PATENT DOCUMENTS

| | | |
|---|---|---|
| CN | 207261577 U | 6/2018 |
| DE | 4303678 C2 | 8/1994 |

(Continued)

*Primary Examiner* — Noah Chandler Hawk

(74) *Attorney, Agent, or Firm* — McNees Wallace & Nurick LLC

(57) ABSTRACT

In an exemplary embodiment, a wind resistant parasol is disclosed which includes a pole and a rib mechanism attached to the pole. The rib mechanism includes a plurality of upper ribs configured to support an upper canopy, a plurality of lower ribs configured to support a lower canopy, and a rib connector connecting the plurality of upper ribs and the plurality of lower ribs together to form a closed loop. When the parasol is open, the upper canopy has a substantially flat profile and the lower canopy has a curved profile formed by the respective plurality of upper ribs and the plurality of lower ribs, wherein the lower canopy is configured to guide air pressure in a downward direction causing the parasol to stabilize.

19 Claims, 28 Drawing Sheets

(56) References Cited

U.S. PATENT DOCUMENTS

| | | | | |
|---|---|---|---|---|
| 9,549,595 | B1 * | 1/2017 | Liu | A45B 19/00 |
| 9,986,799 | B1 * | 6/2018 | King | A45B 25/18 |
| 2004/0211451 | A1 * | 10/2004 | Goh | A45B 25/20 135/31 |
| 2006/0011226 | A1 | 1/2006 | Santos | |
| 2006/0278261 | A1 * | 12/2006 | Marcelli | A45B 25/22 135/98 |
| 2008/0163910 | A1 | 7/2008 | Hollinger | |
| 2011/0108074 | A1 | 5/2011 | You | |

FOREIGN PATENT DOCUMENTS

| | | | |
|---|---|---|---|
| DE | 10128940 | C1 | 11/2002 |
| KR | 20160004228 | A | 1/2016 |

* cited by examiner

WIND RESISTANT PARASOL

TECHNICAL FIELD

The present disclosure relates to a parasol. More specifically, the present disclosure is directed to a wind resistant parasol that significantly reduces inversion of the parasol against wind.

BACKGROUND

A parasol, also known as an umbrella, is used to shield elements of nature, such as sun, wind, and/or rain. Parasols are typically used in summer and can effectively prevent ultraviolet rays from damaging the skin. The parasol can be fixed to outdoor furniture, such as a terrace table can be or used on the beach. The winds and gusts that accompany bad weather can usually easily turn a canopy of the parasol inside out. Typically, in traditional parasols, while encountering windy weather, the wind blows towards an area under the canopy that is usually open creating a higher pressure towards an upper direction. As a result of higher pressure being created towards the upper direction of the canopy, the parasol usually turns inside out or tends to get inverted or is blown off from its position (due to not being able to withstand this higher force towards the upper direction).

Typically, in order to prevent the parasol (e.g., a beach parasol) from being blown away or getting inverted, the canopy is often secured via a pole using complicated mechanisms or measures, however, such measures are proved to provide unsatisfactory results. In most cases, the canopy is blown out or inverted rendering the parasol permanently damaged. Moreover, if the canopy is inverted by wind or gusts, the individual using the parasol becomes completely unprotected from the elements (e.g., sunlight, rain) as a result.

A number of solutions have been proposed to thwart these problems. Some of the solutions incorporate additional metal stays and/or venting mechanisms. For example, pulling ropes can be used to prevent inversion of the parasol. In another example, the parasol can include a reinforced rib structure designed to prevent inversion. In another further example, a venting technique embodied in the canopy can be employed to prevent inversion due to high winds. However, the available parasols are generally too complicated to be operated efficiently or manufacture in a cost-effective manner.

In view of the problems associated with conventional parasols, there remains a need to provide a parasol that will protect the user from undesired elements (i.e., rain, snow, sunlight, etc.), while withstanding any winds and/or gusts that may accompany these weather conditions. Further, there is a need for a wind resistant parasol that significantly prevents turning or inverting of the canopy.

SUMMARY

In an exemplary embodiment, a wind resistant parasol is disclosed which includes a pole and a rib mechanism attached to the pole. The rib mechanism includes a plurality of upper ribs configured to support an upper canopy, a plurality of lower ribs configured to support a lower canopy, and a rib connector connecting the plurality of upper ribs and the plurality of lower ribs together to form a closed loop. When the parasol is open, the upper canopy has a substantially flat profile and the lower canopy has a curved profile formed by the respective plurality of upper ribs and the plurality of lower ribs, wherein the lower canopy is configured to guide air pressure in a downward direction causing the parasol to stabilize.

In another exemplary embodiment, a wind resistant parasol is disclosed which includes a pole, an upper canopy, a lower canopy attached to the upper canopy, and a rib mechanism including a plurality of upper ribs to support the upper canopy and a plurality of lower ribs to support the lower canopy, wherein the upper canopy and the lower canopy are configured over the plurality of upper ribs and the plurality of lower ribs, respectively, forming a hollow airfoil. The lower canopy has a convex shape such that an inner facing portion of the lower canopy is directed upwards which guides air pressure in a downward direction and forces the parasol towards a ground.

Other features and advantages of the present invention will be apparent from the following more detailed description of the preferred embodiment which illustrates, by way of example, the principles of the invention.

Figure 1A:
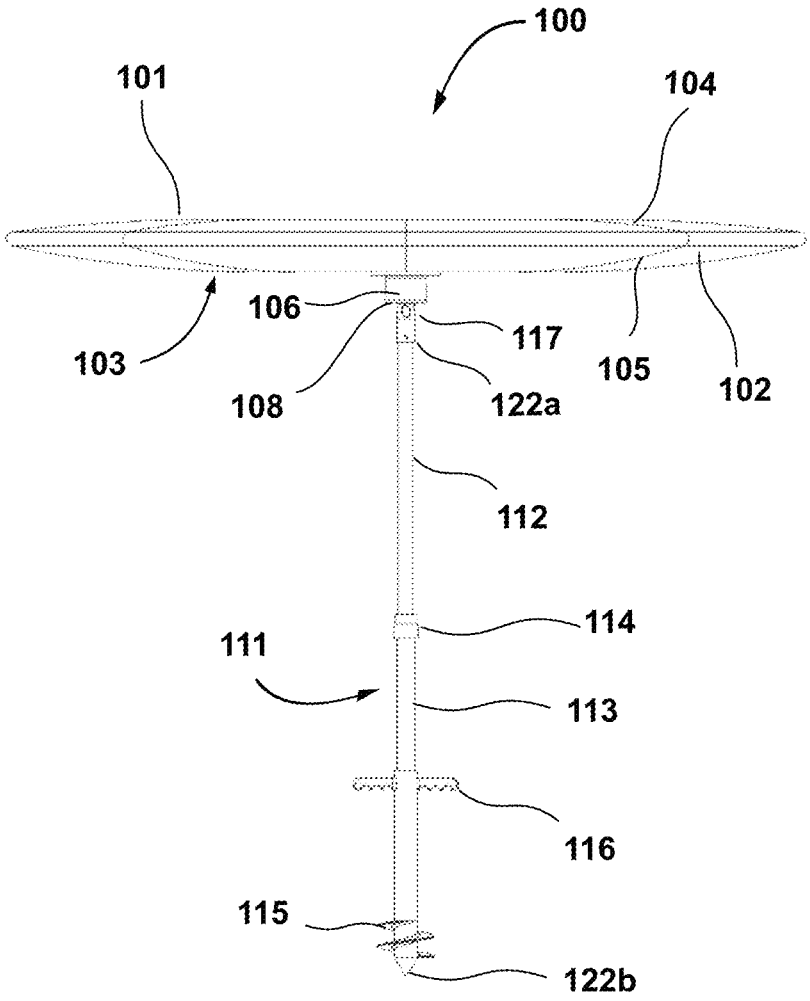
FIGS. 1A-1C are different perspective views of a wind resistant parasol at an opened position, according to an example embodiment of the present disclosure.

It should be noted that these Figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. For example, the relative thicknesses and positioning of layers, regions and/or structural elements may be reduced or exaggerated for clarity. The use of similar or identical reference numbers in the various drawings is intended to indicate the presence of a similar or identical element or feature.

DETAILED DESCRIPTION

It is an object of the present disclosure to provide a wind resistant parasol with an improved wind-guided performance in windy conditions. Unlike traditionally available parasols, the present parasol disclosed herein is designed to embody an upper canopy and a lower canopy, where the lower canopy helps in releasing air pressure below the parasol while effectively shedding rain, snow, sunlight, etc. and, preventing inversion of the canopy.

It is another object of the present disclosure to provide a wind resistant parasol/umbrella designed to incorporate aerodynamic principles that helps in stabilizing the parasol against strong winds and provides firm fixation of the parasol into the ground instead of being lifted up from the ground.

It is another object of the present disclosure to provide a wind resistant parasol adapted for guiding a sufficient volume of air in a downward direction to relieve pressure from below the bottom of the canopy of the parasol while shedding the elements from top of the canopy.

It is another object of the present disclosure to provide a wind resistant parasol that is effective and volumetrically efficient.

It is another object of the present disclosure to provide a wind resistant parasol that can be easily disassembled and transported.

It is another object of the present disclosure to provide a wind resistant parasol that is inexpensive to manufacture and maintain while retaining its effectiveness.

Example embodiments disclosed herein provide a new and improved wind resistant parasol with reduced turning probability (i.e., inversion) against the wind and improved wind-guided performance. The proposed parasol can reduce the amount of air getting accumulated on an upper canopy by providing a lower canopy having a unique shape. More specifically, in one implementation, the present parasol can be designed as a hollow "upside down airplane wing design" so that when wind blows it creates lift that forces the parasol into the ground or structure rather than lifting it out of the ground or structure as with current, existing designs. In other words, the lower canopy has a convex shape such that an inner facing portion of the lower canopy is directed upwards. It is also aerodynamically designed to minimize drag on the parasol under windy conditions.

The present disclosure provides a wind resistant parasol with a camber design of airfoil such that lift force is toward the ground. The camber design is an asymmetry profile between a surface of an upper canopy and a surface of a lower canopy, with the lower canopy being more convex (i.e., positive camber).

As described herein, the term "parasol" is interchangeable with "umbrella" and described in a similar manner.

As described herein, the term "wind resistant" parasol is a parasol that has been designed to remain open and to avoid breaking when strong winds are blowing.

Figure 1B:
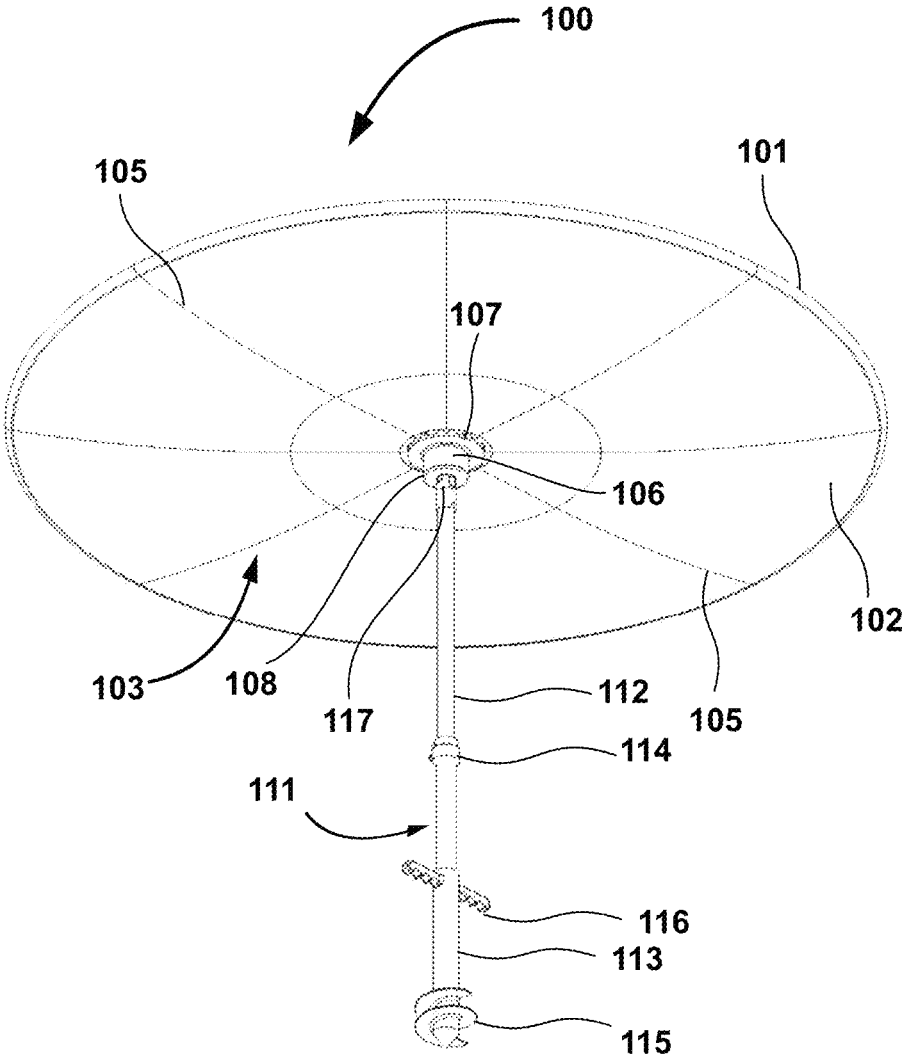
Figure 1C:
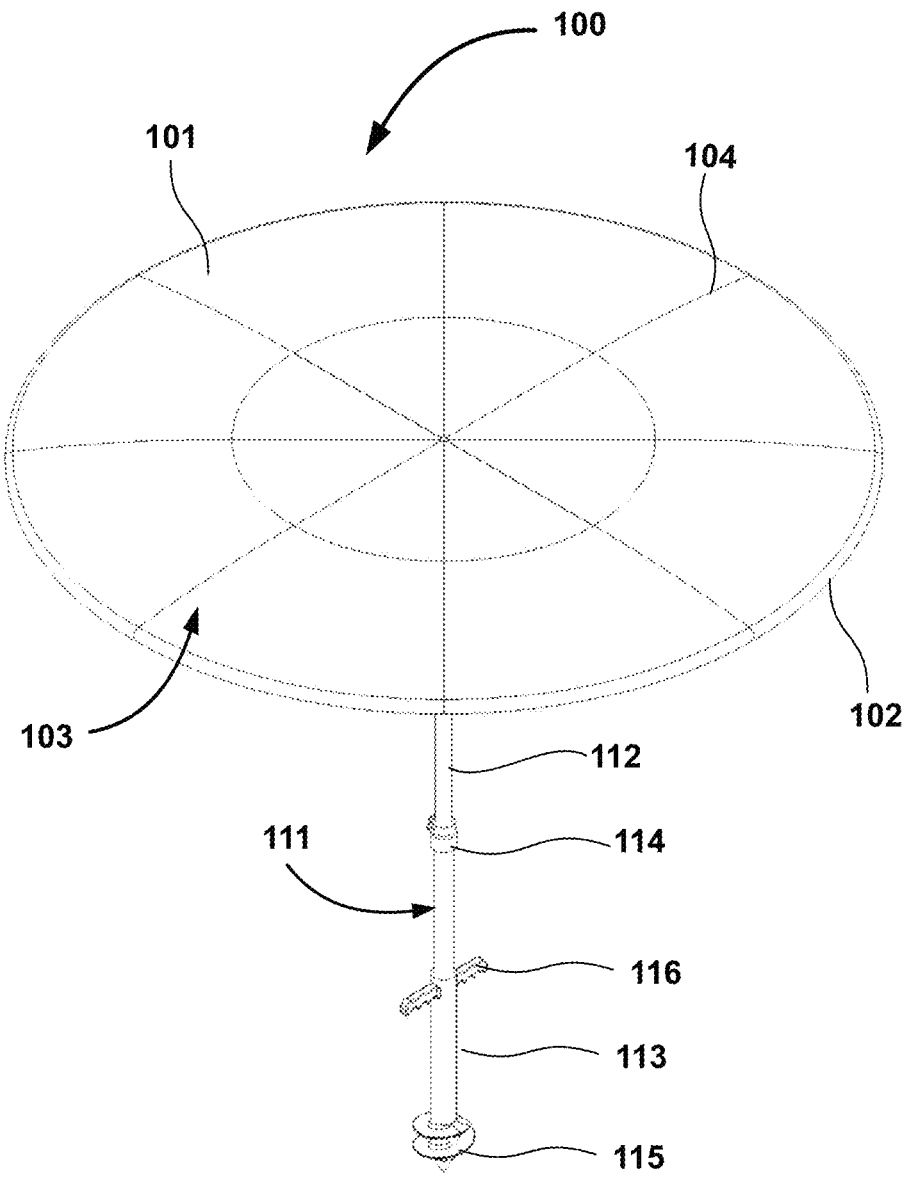

FIGS. 1A-1C are perspective views of a parasol 100 in accordance with an example embodiment of the present disclosure. The parasol 100 is a type that is commonly referred to as a beach umbrella that is used to protect users from the elements, such as, sun, rain, wind, etc. It will be appreciated and understood that the various features of the present invention described herein can be implemented in other types of umbrellas/parasols besides beach umbrellas.

Figure 1D:
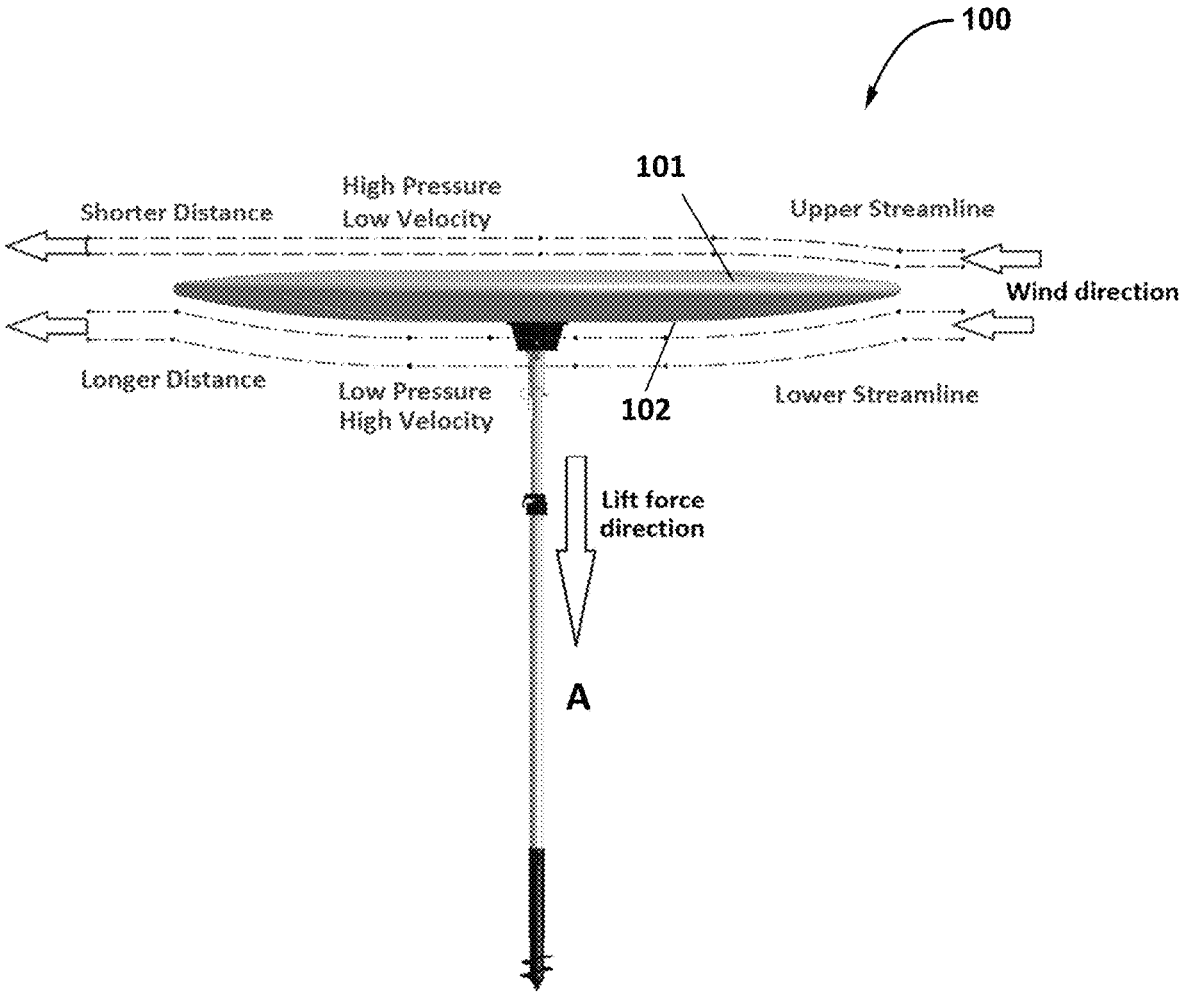
FIG. 1D is a perspective view of a wind resistant parasol illustrating a wind effect on the parasol, according to an example embodiment of the present disclosure.

As shown in FIGS. 1A-1C, the parasol 100 includes an upper canopy 101, a lower canopy 102, a rib mechanism 103, and a pole 111. The rib mechanism 103 is connected to the pole 111, which will be described in detail later. The upper canopy 101 is attached to an upper portion of the rib mechanism 103 to shed rain, snow, sunlight, etc. and the lower canopy 102 is attached to a lower portion of the rib mechanism 103 to guide the wind in a downwardly direction (i.e., ground). Due to the shapes of the upper canopy 101 and the lower canopy 102 created by the rib mechanism 103, a wind resistant parasol 100 is produced. Specifically, the parasol 100 has an upside-down (i.e., inverted, reversed, flip-flopped) configuration where the lower canopy 102 has a convex shape to guide the wind such that the parasol 100 is forced into the ground. To describe in a different manner, and referring to FIG. 1D, a profile of the upper canopy 101 is substantially flat and a profile of the lower canopy 102 is curved (or convex) to face toward the sky. This can be described as having an "upside down airplane wing" design, which produces downward lift force and minimize drag compared to existing parasol designs. According to principles of air dynamics, it is known that air will move from a high pressure area to a low pressure area. It is also known that the air pressure beneath the parasol 100 is lower than the air pressure above the parasol 100. As air blows across the parasol 100, air pressure below the parasol 100 is lower, thus preventing inversion of the upper and lower canopies 101, 102 in windy weather. The lower canopy 102 uses an aerodynamic principle to stabilize the parasol 100 during high winds by exerting force towards the ground instead of getting lifted up due to winds pressure. That is, air pressure exerts a (lift) force (arrow A) on the lower canopy 102 and urges the pole 111 into the ground reducing parasol 100 from lifting, falling or collapsing. In contrast to conventional parasols, the lower canopy is concave so that wind pressure exerts a lifting (upward) force and torque on the parasol, urging the parasol out of its fixed position by virtue of the pressure force and the torque exerted on the pole. Additionally, principles of aerodynamic dictates that air moving over a surface at a higher speed than under the surface creates lift. Accordingly, as shown in FIG. 1D, air across the lower canopy 102 has a higher velocity than the air across the upper canopy 101. As a result, the lift force is toward the ground causing a wind resistant parasol 100.

In some implementations, an outer edge of the upper canopy 101 surface and an outer edge of the lower canopy 102 surface are connected together to increase the bonding strength of the entire canopy surface. As such, the provided wind resistant parasol is effective and volumetrically efficient. In one implementation, the upper canopy 101 and the lower canopy 102 are integrally formed to form a single canopy that surrounds the rib mechanism 103 creating a hollow sun-shade frame. In other words, the upper canopy 101 and the lower canopy 102 form a seamless canopy which surrounds the rib mechanism 103, forming a hollow airfoil. In other implementations, the upper canopy 101 and the lower canopy 102 are separately formed and connected together functioning similarly as a single canopy.

In some implementations, the upper canopy 101 and/or the lower canopy 102 can be made from polyester or nylon fabric or any other suitable material. The polyester and the nylon fabric are waterproof and lightweight. In some implementations, the upper canopy 101 and/or the lower canopy 102 are made from a heat-resistance fabric.

Figure 2A:
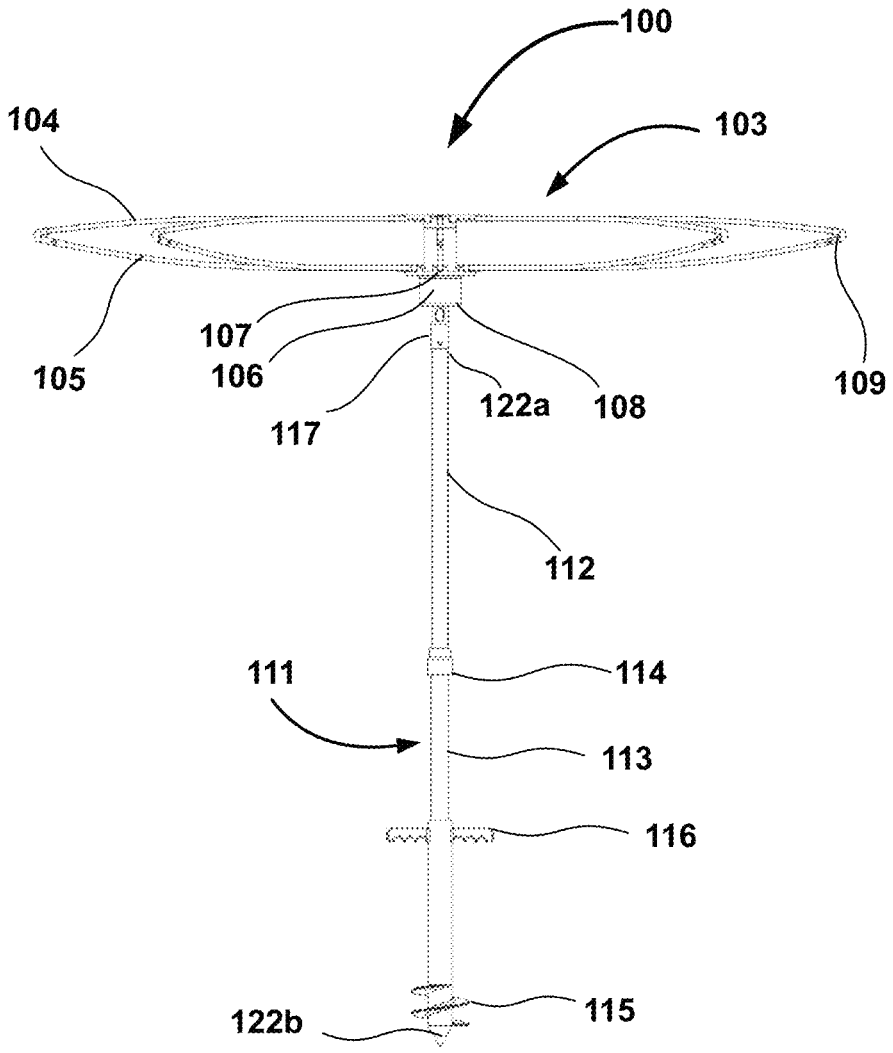
FIGS. 2A-2C are perspective views of the wind resistant parasol of FIGS. 1A-1C without an upper canopy and a lower canopy, according to an example embodiment of the present disclosure.
Figure 2B:
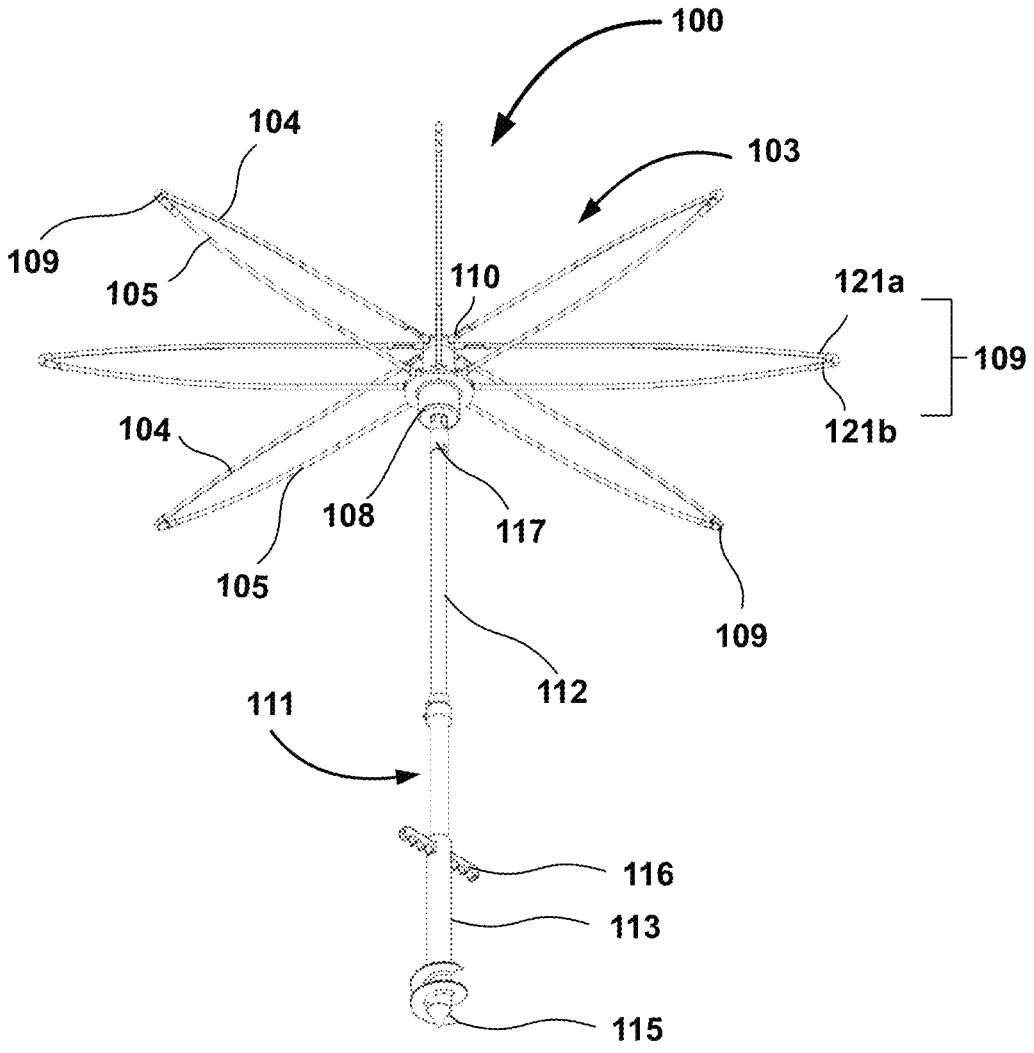
Figure 2C:
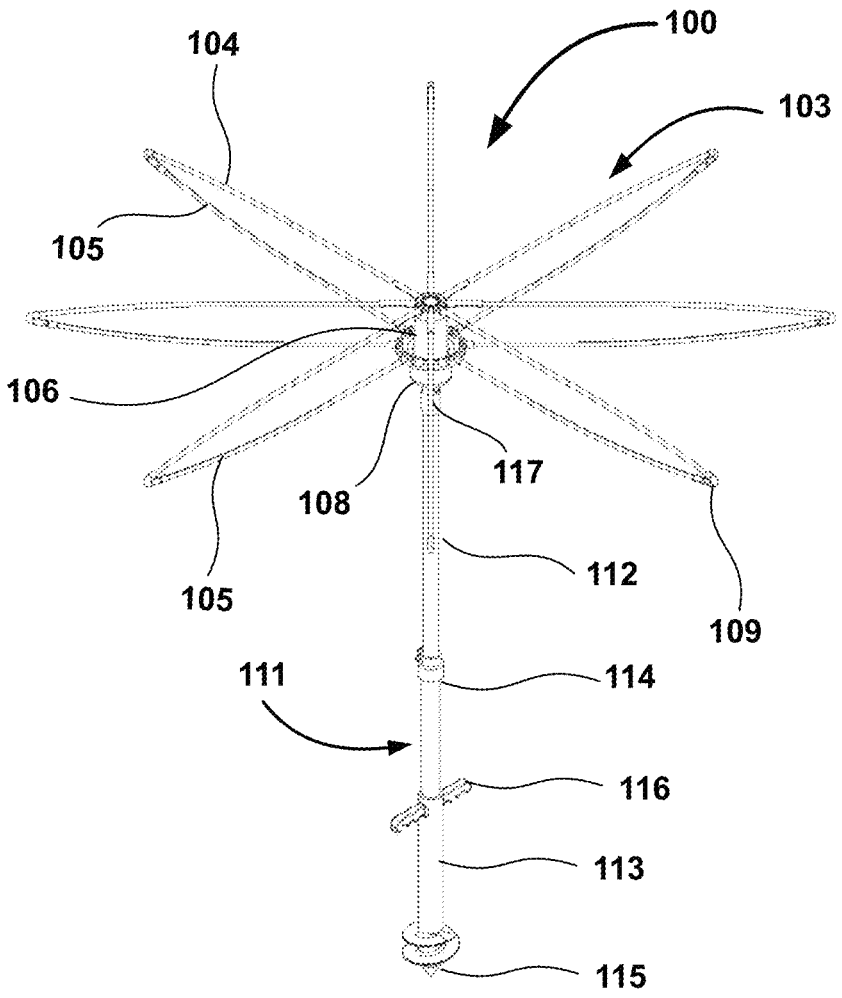

The rib mechanism 103 includes a plurality of upper ribs 104, a plurality of lower ribs 105, a first holder 106, a second holder 107, and a stopper 108, as shown in FIGS. 2A-2C. In some implementations, the plurality of upper ribs 104 and the plurality of lower ribs 105 are identical in shape, size, and dimensions. In other implementations, the plurality of upper ribs 104 and the plurality of lower ribs 105 are different in size and shape. For example, the upper ribs 104 can have a space on an undersurface thereof to accommodate housing a portion of the plurality of the lower ribs 105 when in a collapsed position. In some implementation, the plurality of upper ribs 104 and the plurality of lower ribs 105 are made from an elastic material such as fiber glass reinforced plastic material having a cross section of a circular shape. In some implementations, the plurality of lower ribs 105 are made from a material that is more flexible than the plurality of the upper ribs 104, to accommodate fitting within the upper ribs 104 in a collapsed position. It should be appreciated that other materials can be employed, such as, for example, light aluminum alloy, carbon fiber, or any other suitable materials having proper elasticity and toughness. Further, it should be appreciated that other shapes, such as rectangular, square, flat or arcuate, can be employed to form the plurality of upper ribs 104 and the plurality of lower ribs 105.

The plurality of upper ribs 104 and the plurality of lower ribs 105 are connected together using a rib connector 109 disposed at an end farthest (distal) from the pole 111. In other words, the plurality of upper ribs 104 and the plurality of lower ribs 105 are connected together, via the rib connector 109, to form a closed loop. The rib connector 109 includes a first rib arm portion 121*a* and a second rib arm portion 121*b* with a predetermined angle therebetween, as shown in FIG. 2B. In some implementations, the formed predetermined angle of the rib connector 109 is less than 45°, preferably 30°. Moreover, due to the predetermined angle of the rib connector 109, it provides advantages and improvements over conventional parasols. For example, the angled rib connector 109 permits improved directional stability by providing lift in opposition to upward force on the upper canopy 101, reduces wind resistance on the upper canopy 101 and the lower canopy 102, and/or promotes laminar flow around its rounded shape, with lower resulting drag. Each of the first rib arm portion 121*a* and the second rib arm portion 121*b* are hollow, such that the first rib arm portion 121*a* receives one of the plurality of upper ribs 104 thereinside and the second rib arm portion 121*b* receives one of the plurality of lower ribs 105 thereinside.

The first holder 106 is rigidly fixed to a top end portion 122*a* of the pole 111. In some implementations, the first holder 106 is configured with a plurality of outer threads for meshing with threads configured inside the pole 111. In other implementations, the first holder 106 is attached to the top end portion 122*a* of the pole 111 via fastening means, such as, for example, screws, nuts and bolts, anchors, rivets, adhesives, glue, etc.

Figure 4:
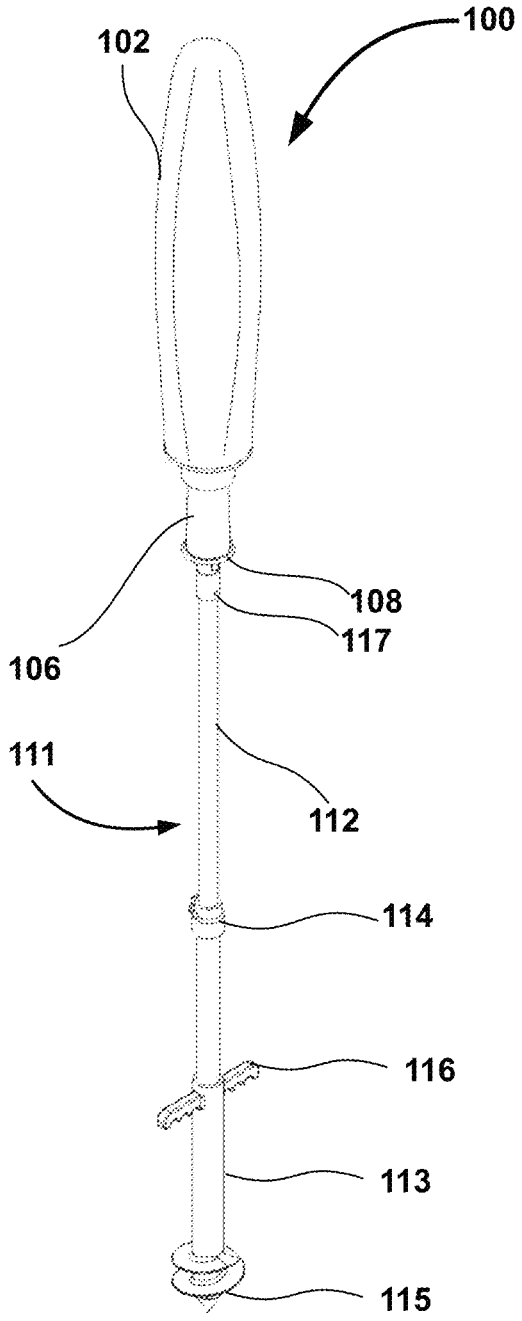
FIG. 4 is a perspective view of FIG. 3B with the upper canopy and the lower canopy, according to an example embodiment of the present disclosure.
Figure 5:
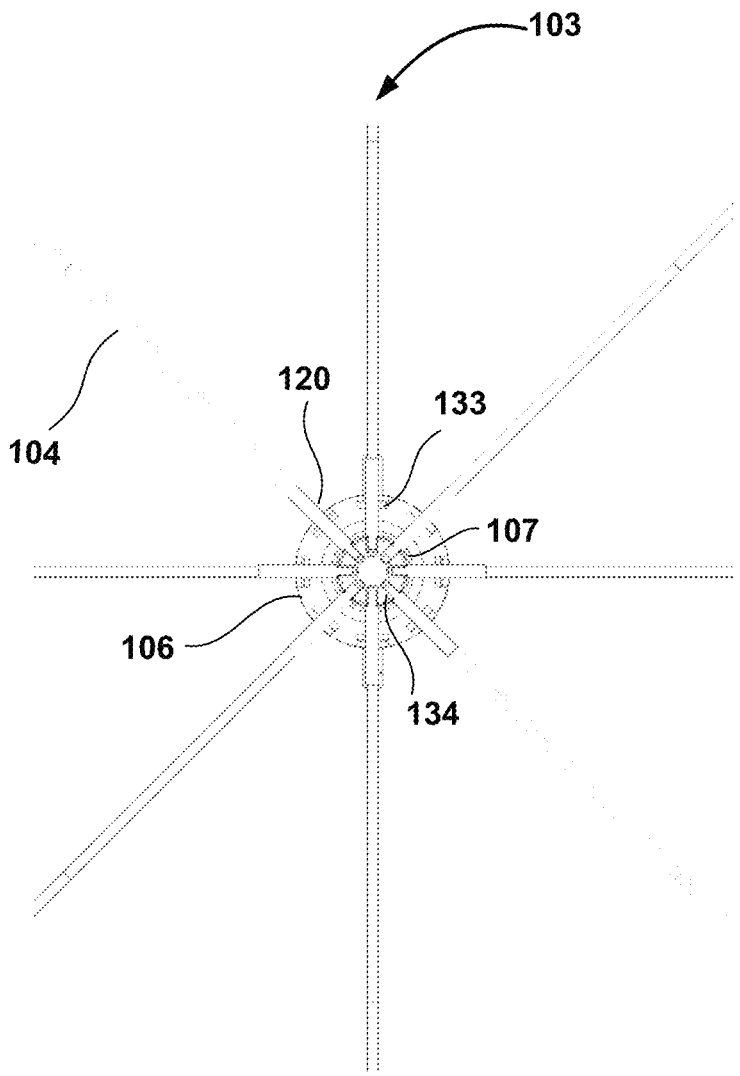
FIG. 5 is a perspective view of a rib mechanism of the wind resistant parasol, according to an example embodiment of the present disclosure.
Figure 6:
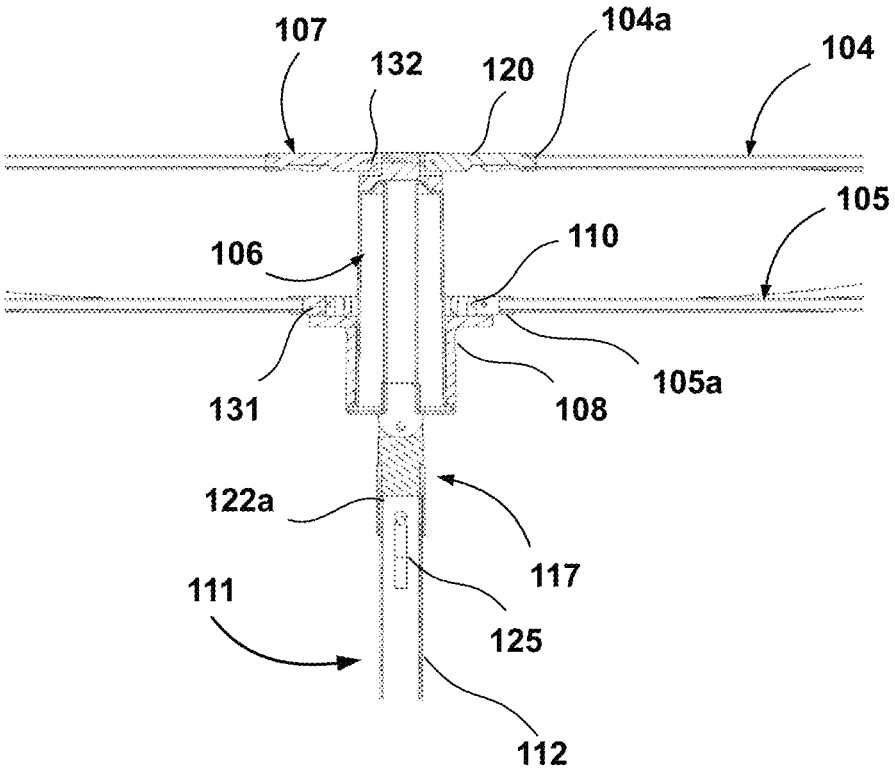
FIG. 6 is a cross-sectional view of a rib mechanism, according to an example embodiment of the present disclosure.

As shown in FIG. 6, the first holder 106 is provided with a plurality of first extensions 110 with an equal angular distance therebetween. Each of the first extensions 110 is provided with a hollow opening configured to receive an end of the plurality of lower ribs 105. In one implementation, a first end 105*a* of the lower rib 105 is fixed (or inserted) to the first extension 110 of the first holder 106. The first extensions 110 are pivotally affixed via a pin 131 to the first holder 106. That is, the first extensions 110 are configured to pivotally move upward to move the plurality of lower ribs 105 in the same direction. This permits the plurality of lower ribs 105 to move in an upward direction and place the lower canopy 102 in a non-use configuration, as shown in FIG. 4. In some implementations, the first holder 106 includes a plurality of first grooves 133 (as shown in FIG. 5) made therebetween to hold the first extensions 110 in place. The first grooves 133 ensure that the first extensions 110 are securely placed against (or within) the first holder 106 from lateral movements (i.e., side-by-side movements).

On top of the first holder 106, the second holder 107 is attached thereto. In some implementation, the second holder 107 is slidably configured with the first holder 106. In some implementations, an inner diameter of the second holder 107 is larger than an outer diameter of the first holder 106 so as to connect the second holder 107 and the first holder 106 together. In one implementation, the second holder 107 can be attached to the first holder 106 by a threaded arrangement on top of the first holder 106. It should be appreciated that other fastening means may be employed to attach the second holder 107 to the first holder 106, such as, for example, screws, nuts and bolts, anchors, rivets, adhesives, glue, etc. Similar to the first holder 106, the second holder 107 includes a plurality of second extensions 120 with an equal angular distance therebetween. Each of the second extensions 120 is provided with a hollow opening configured to receive an end of the plurality of upper ribs 104. In one implementation, a first end 104*a* of the upper rib 104 is fixed (or inserted) to the second extension 120 of the second holder 107. The extensions 120 are pivotally affixed via a pin 132 to the second holder 107. That is, the extensions 120 are configured to pivotally move upward to move the plurality of upper ribs 104 in the same direction. As such, this permits the plurality of upper ribs 104 to move in an upward direction and place the upper canopy 101 in a non-use configuration. In some implementations, the second holder 107 includes a plurality of second grooves 134 (as shown in FIG. 5) made therebetween to hold the second extensions 120 in place. The second grooves 134 ensure that the second extensions 120 are securely placed against (or within) the second holder 107 from lateral movements (i.e., side-by-side movements).

The stopper 108 is disposed below the first holder 106. In some implementations, the stopper 108 is integrally formed at a bottom of the first holder 106. In one implementation, the stopper 108 is a circular disc with a diameter greater than a diameter of the first holder 106 and/or a diameter of the second holder 107. The stopper 108 restricts linear movement of the second holder 107 over the first holder 106. In some implementations, there may be provided a locking mechanism to lock the second holder 107 in place once the second holder 107 has been restricted to move (during opening of the parasol 100) by the stopper 108. In some implementations, the stopper 108 can be made from any suitable material such as plastic, metal, or elastic, to reduce stress and torque applied by the first holder 106 and/or the second holder 107.

In use, to open the parasol 100, a user moves the second holder 107 towards the stopper 108, i.e., in a downward direction. The stopper 108 limits the downward motion of the second holder 107. The downward motion of the second holder 107 pulls the plurality of upper ribs 104 and the plurality of lower ribs 105 connected to the upper canopy 101 and the lower canopy 102, respectively, in the downward direction. Hence, the upper canopy 101 and the lower canopy 102 open to form an aerodynamic structure, as discussed above.

Figure 3A:
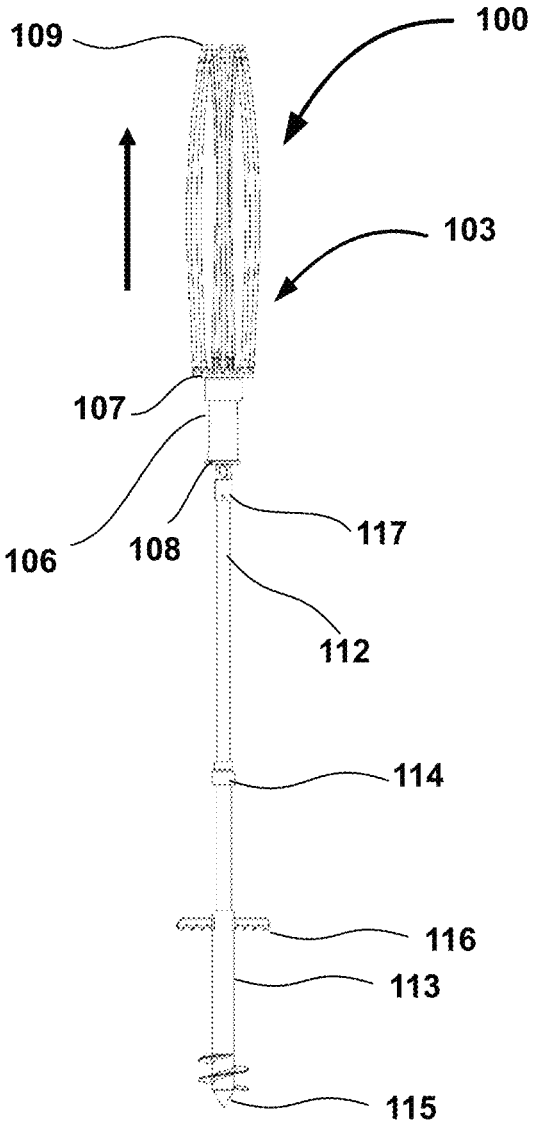
FIGS. 3A and 3B are perspective views of the wind resistant parasol at a closed position without an upper and lower canopy, according to an example embodiment of the present disclosure.
Figure 3B:
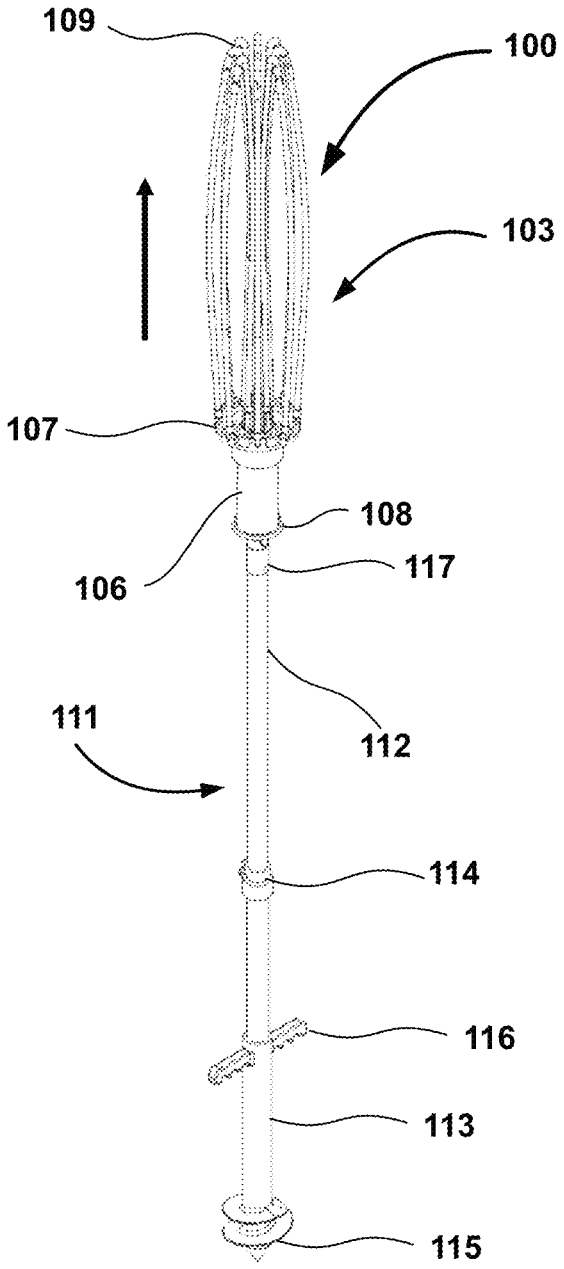

To close the parasol 100, the user moves the second holder 107 away from the stopper 108, i.e., in an upward direction. The upward motion of the second holder 107 pushes the plurality of upper ribs 104 and the plurality of lower ribs 105 connected to the upper canopy 101 and the lower canopy 102, respectively, in the upward direction, as shown in FIGS. 3A and 3B. During the closure operation, the upper canopy 101 and the lower canopy 102 are folded. More specifically, the lower canopy 102 will surround the upper canopy 101 hiding the upper canopy 104 from view, as shown in FIG. 4.

Figure 7:
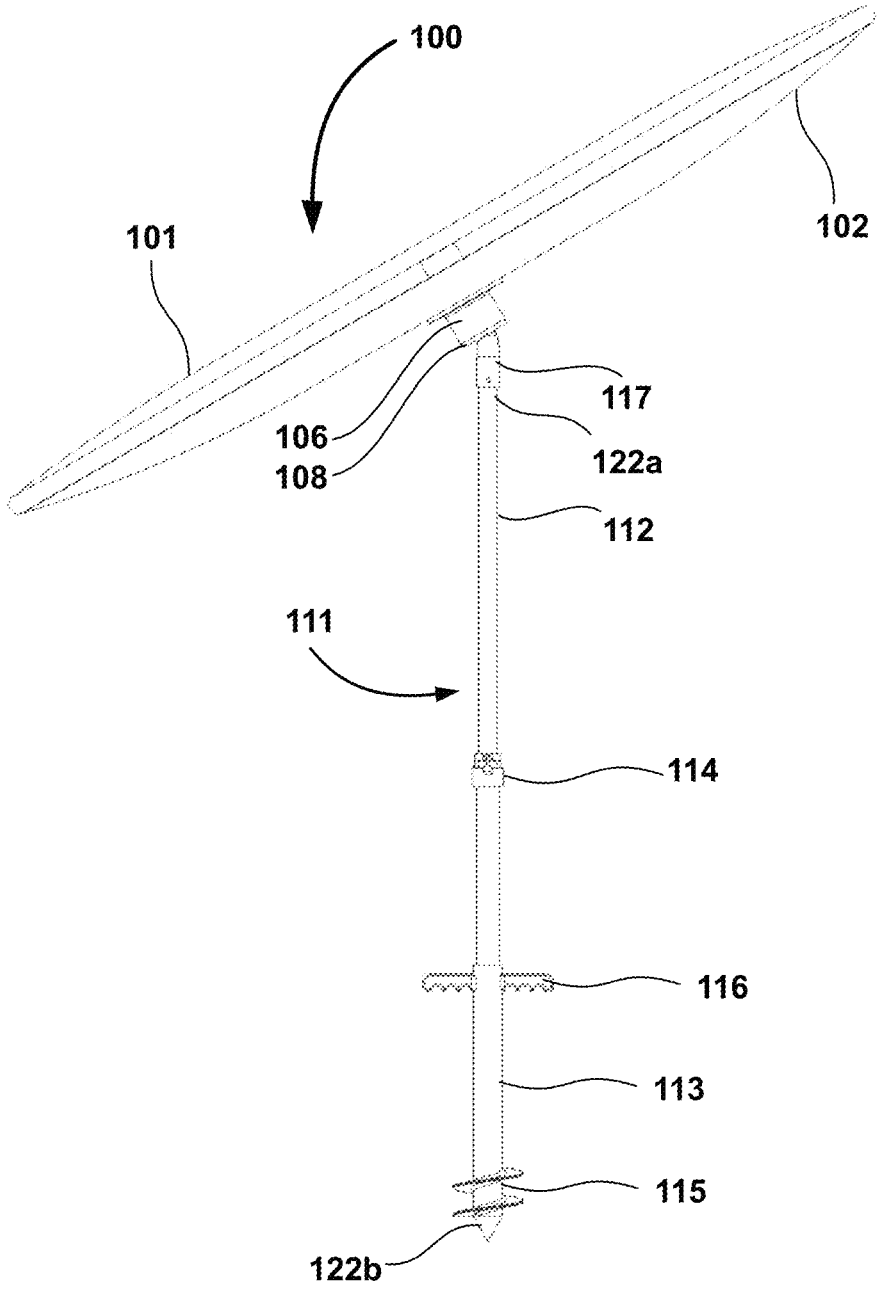
FIG. 7 is a perspective view of the wind resistant parasol at a tilted position, according to an example embodiment of the present disclosure.

Referring now to FIGS. 6 and 7, a tilting mechanism 117 is provided for adjusting an angle of the upper canopy 101 and the lower canopy 102 configured onto the rib mechanism 103. The tilting mechanism 117 can adjust the angle of the upper canopy 101 and the lower canopy 102 of approximately 0° to 45° with respect to the pole 111 in either direction. In other words, the upper canopy 101 and the lower canopy 102 can be adjusted up-and-down approximately 0° to 45° via the tilting mechanism 117. In some implementations, the tilting mechanism 117 can permit the upper canopy 101 and the lower canopy 102 to rotate 360° about its axis, i.e., the pole 111. The tilting mechanism 117 is connected to the top end 122*a* of the pole 111. For example, the tilting mechanism 117 is connected to the top end portion 122*a* of the pole 111 by a threaded configuration. Specifically, the titling mechanism 117 has outer threads that are cooperatively engaged to inner threads of the pole 111. In some implementations, the tilting mechanism 117 includes a locking and releasing member 125 to lock the tilting mechanism 117 in place or release the tilting mechanism 117 and adjust the upper canopy 101 and the lower canopy 102. For example, the locking and releasing member 125 includes a latch inside of the tilting mechanism 117 to lock or release the position of the tilting mechanism 117. In some implementations, the tilting mechanism 117 includes a crank arm (not shown) to operate the tilting mechanism 117. For example, to adjust the required angle of the rib mechanism 103, the user needs to press an operating member to unlock the crank arm. Similarly, for locking the crank arm at the required angle of the rib mechanism 103, the user needs to release the operating member.

In addition to the titling mechanism 117 being used to adjust the parasol 100 to shield sunlight (i.e., moving the parasol 100 to adjust for the position of the sun), the titling mechanism 117 can also be configured to adjust or accommodate for wind direction. In other words, when the wind is blowing at a certain direction, the parasol 100, via the titling mechanism 117, can be moved to reduce wind resistance and/or create lift in a downwardly direction. For example, if the wind is blowing from an eastward direction, a right-sided portion of the parasol 100 can be adjust via the titling mechanism 117 to move the parasol 100 slightly upwards to create a lift force that moves towards the ground. Moreover, due to the aerodynamic structure of the parasol 100, it reduces air that gets accumulated on the upper canopy 101 and makes the resultant force from the wind to travel in a downward direction from the lower canopy 102. This helps in firm fixation of the pole 111 within the ground or other surface where the parasol 100 is made to stand or be affixed in place.

Referring back to FIGS. 1A-1C, the pole 111 includes a first arm portion 112 and a second arm portion 113 that are telescoping with respect to each other. In some implementations, an outer diameter of the first arm portion 112 is smaller than an inner diameter of the second arm portion 113 such that the first arm portion 112 is slidable inside the second arm portion 113. The pole 111 is further provided with a height adjusting mechanism 114 to adjust the total height of the parasol 100. To reduce the height of the parasol 100, the user needs to operate the height adjusting mechanism 114 in a first manner, thereby the first arm portion 112 slides inside the second arm portion 113. In other words, the first arm portion 112 slides farther into the second arm portion 113. Similarly, to increase the height of the parasol 100, the user needs to operate the height adjusting mechanism 114 in a second manner, thereby the first arm portion 112 slides outside the second arm portion 113. In other words, the first arm portion 112 slides farther away from the second arm portion 113. In some implementations, the height adjusting mechanism 114 can include a locking device to secure the first arm portion 112 with respect to the second arm portion 113 in place. The locking device can be any conventional devices, such as a friction-fit, a knob, a clamp, a bracket, a twist lock, etc., to lock the first and second arm portions 112, 113 together.

At an end 122*b* of the pole 111, a ground fixating device, i.e., an auger 115 is provided, which can be detachably attached to the pole 111. In some implementations, the auger 115 is provided with a torque handle 116. For moving the auger 115 inside the ground, the user needs to operate the torque handle 116 in the first direction (i.e., clockwise direction). Similarly, for removing the auger 115 from the ground, the user needs to operate the toque handle in an opposite direction (i.e., counter-clockwise direction). In some implementations, the auger 115 is a continuous grooving extension that is designed to facilitate insertion of the pole 111 into the ground. In some implementations, the torque handle 116 may be integrally formed with auger 115. In other implementations, the auger 115 and the torque handle 116 may exist as two different, separate pieces. In some implementations, the auger 115 and/or the torque handle 116 may be integrally formed on the pole 111. In some implementations, the auger 115 and/or the torque handle 116 may be removably attachable to the pole 111.

FIGS. 8A-8D are perspective views of a wind resistant parasol 200 illustrating a rib mechanism that is configured to open/close the parasol, according to another example embodiment of the present disclosure. Like reference numerals will be used in this section and not described further to indicate the presence of a similar or identical element or feature.

Figure 8A:
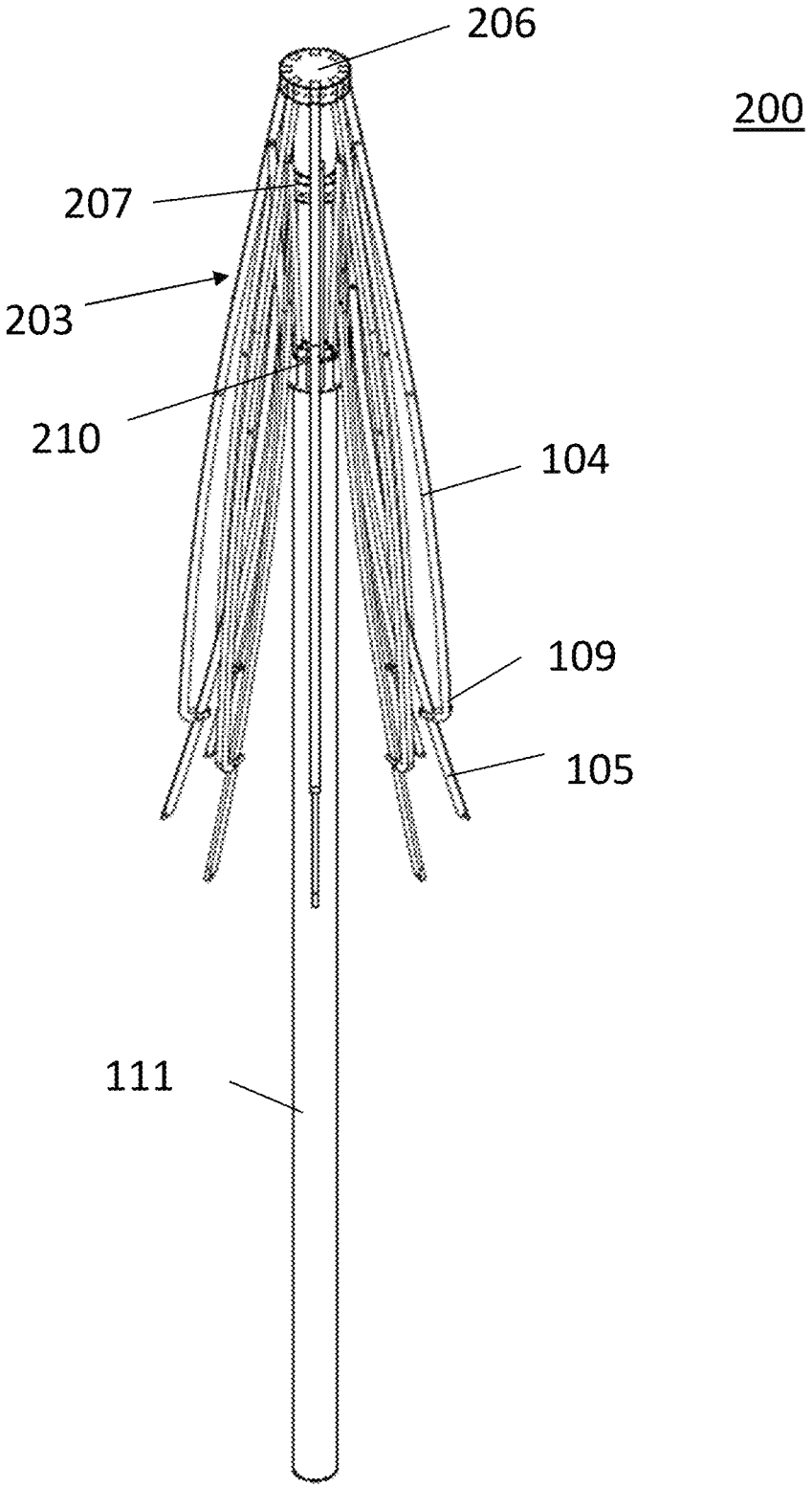
FIGS. 8A and 8B are different perspective views of a wind resistant parasol at a closed position, according to another example embodiment of the present disclosure.
Figure 8B:
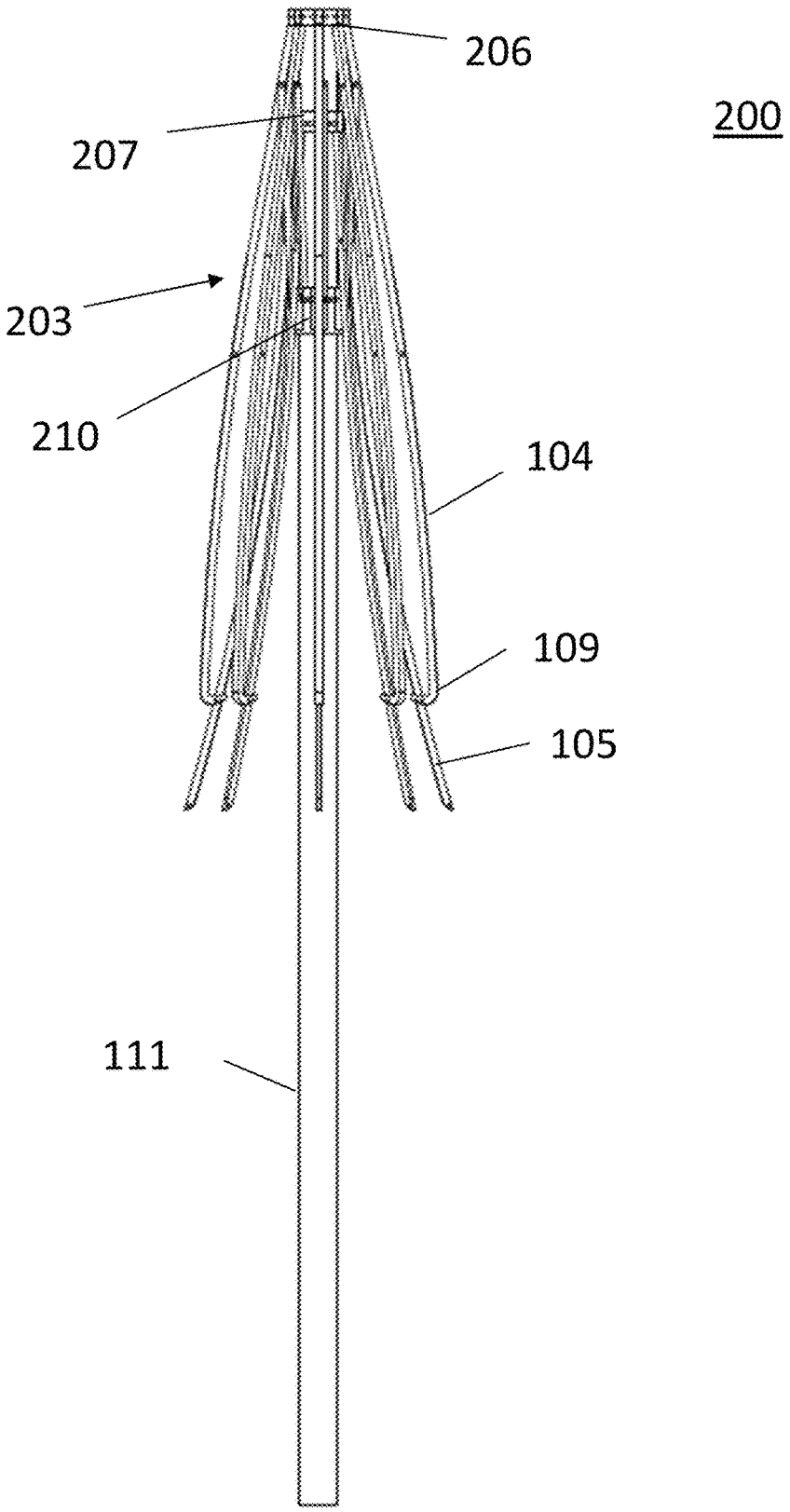
Figure 8C:
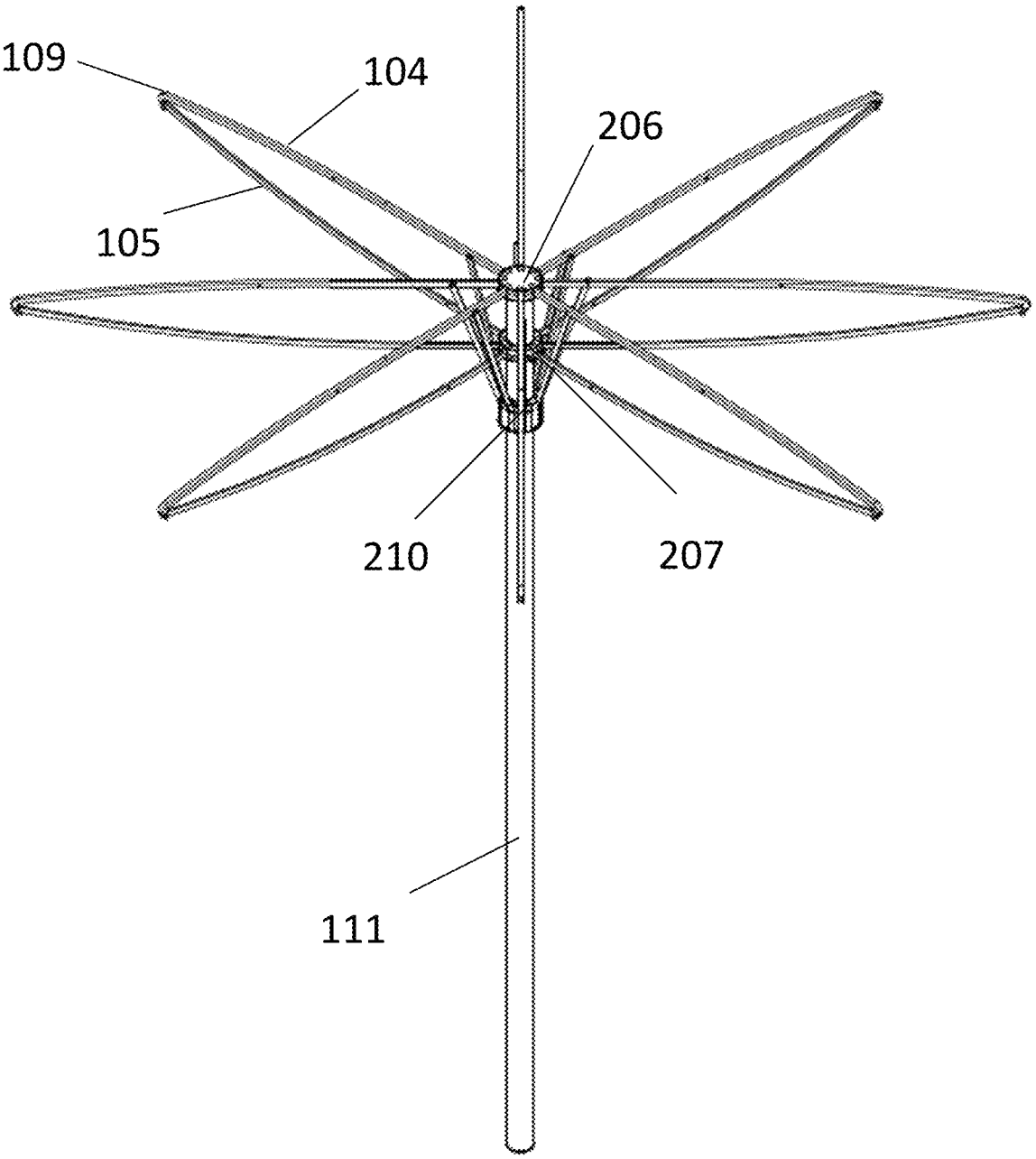
FIGS. 8C and 8D are different perspective views of a wind resistant parasol at an open position, according to another example embodiment of the present disclosure.
Figure 8D:
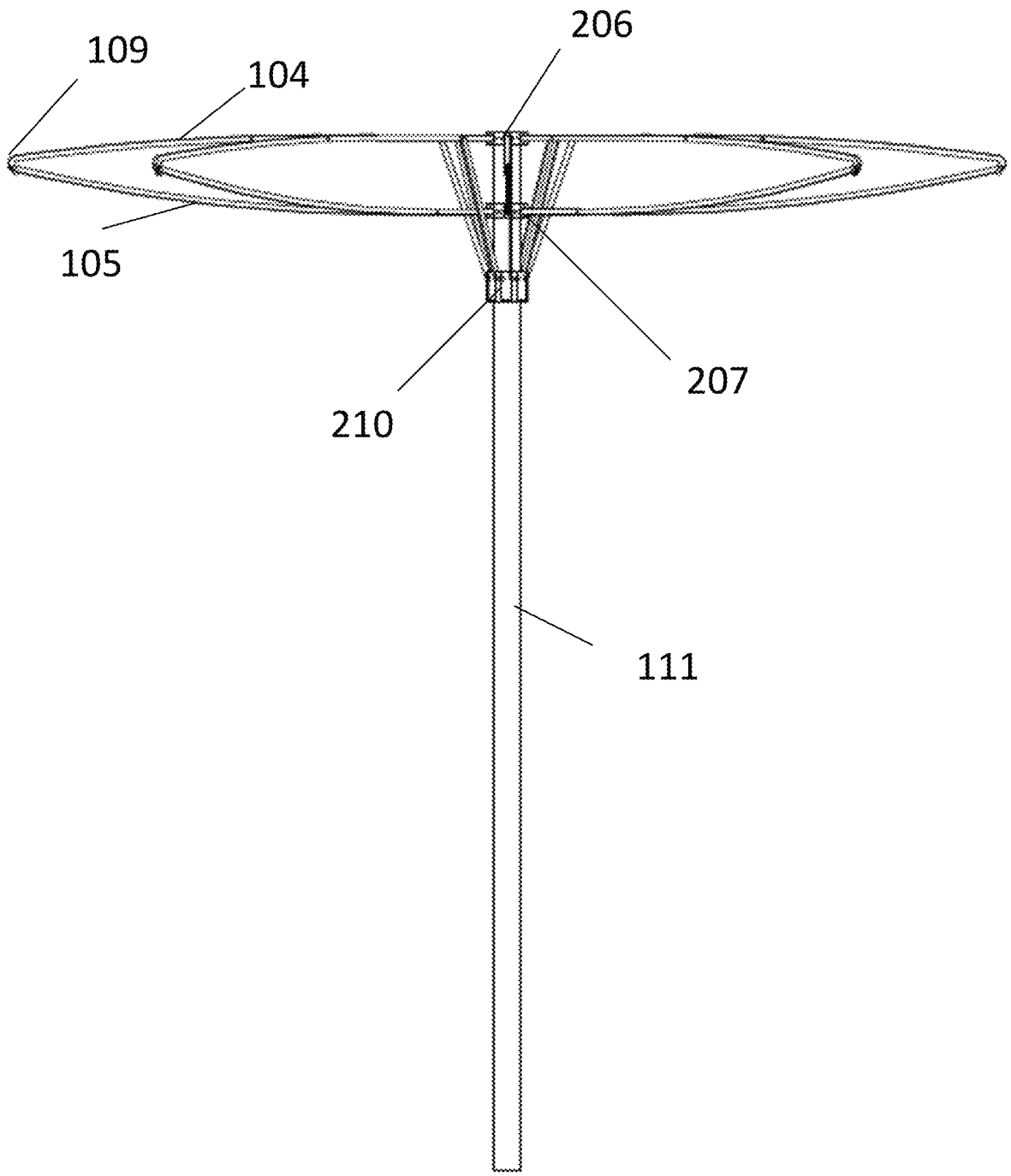

As shown in FIGS. 8A-8D, the wind resistant parasol 200 (depicted without a canopy) includes a rib mechanism 203 having a plurality of upper ribs 104 and a plurality of lower ribs 105. The plurality of upper ribs 104 and the plurality of lower ribs 105 are connected together by a rib connector 109 forming a closed loop. The rib connector 109 is located near a pole 111 when in its closed configuration, as shown in FIGS. 8A and 8B; and located distally from the pole 111 when in its open configuration, as shown in FIGS. 8C and 8D. Similar to exemplary parasol 100 discussed above, parasol 200 also has an upside-down (i.e., inverted, reversed, flip-flopped) configuration where a profile of the upper ribs 104 is substantially straight and a profile of the lower ribs 105 is curved (i.e., convex shaped) to guide the wind towards the ground and produce downward lift force.

Figure 9A:
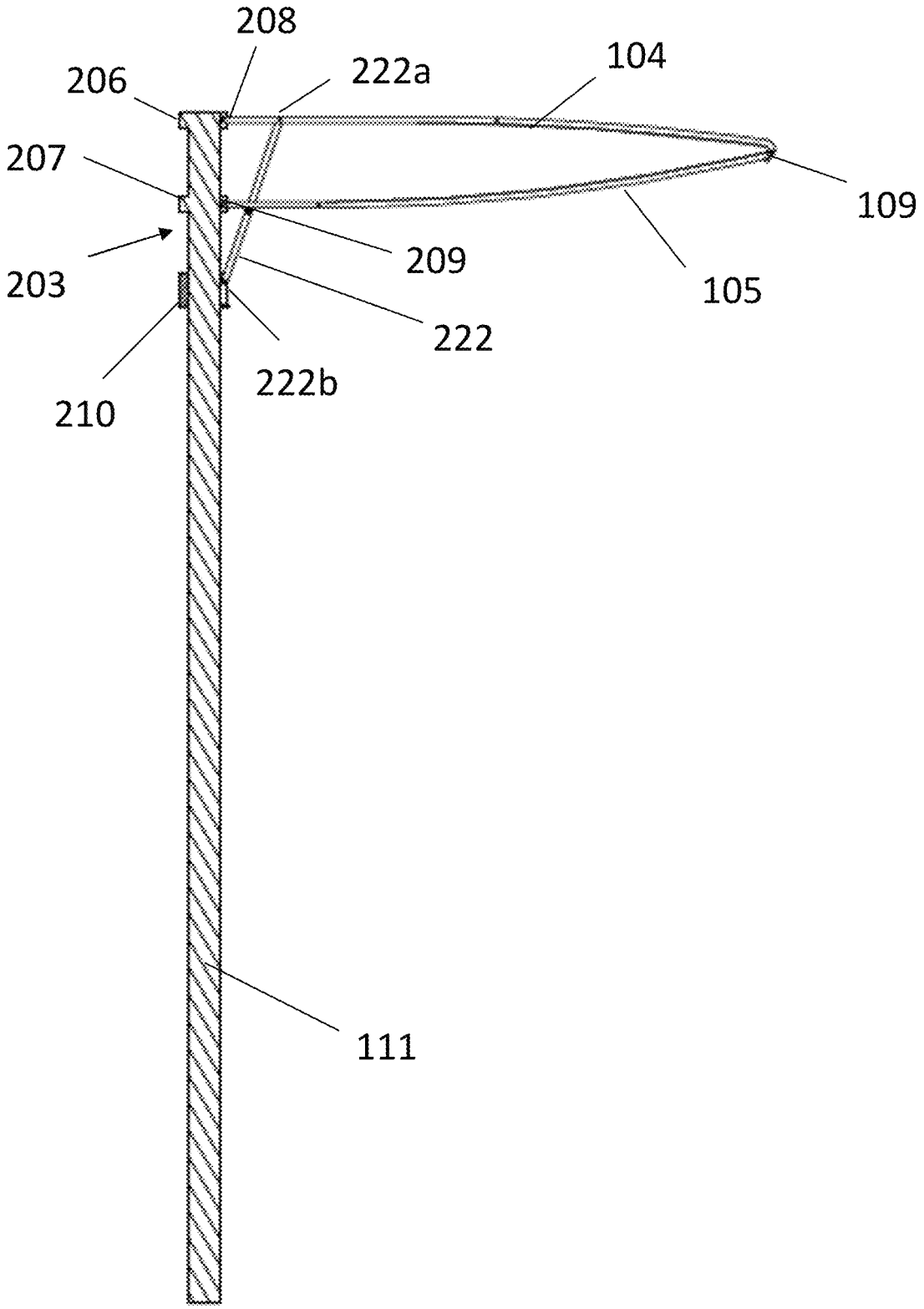
FIG. 9A is a perspective view of the wind resistant parasol at an open position without an upper and lower canopy, according to an example embodiment of the present disclosure.
Figure 9B:
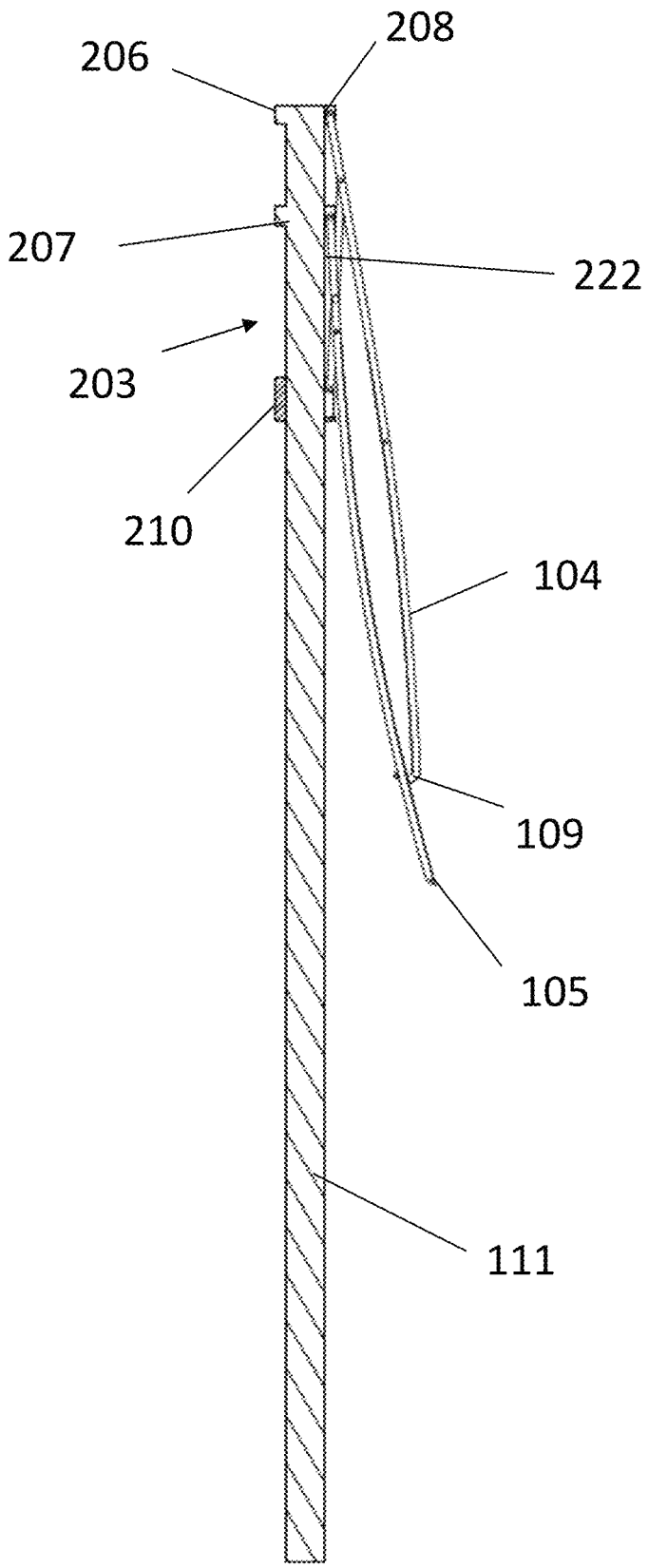
FIG. 9B is a perspective view of the wind resistant parasol at a closed position without an upper and lower canopy, according to an example embodiment of the present disclosure.

Each of the plurality of upper ribs 104 is pivotally connected to a stationary first holder 206 (i.e., hub) attached at the pole 111. The first holder 206 includes a plurality of insertion portions 208 with an equal angular distance therebetween that is configured to receive an end of the upper rib 104, as shown in FIGS. 9A and 9B. The end of the upper rib 104 that is affixed in the insertion portion 208 can pivotally move via a pin (not shown) inserted through the upper rib 104. As such, this permits the plurality of upper ribs 104 to be fixed to the pole 111 while moving in a downward direction and place the upper ribs 104 in a non-use configuration, as shown in FIGS. 8A and 8B. In other implementations, the first holder 206 can include a plurality of first extensions extending outwardly from the respective insertion portions 208. In this exemplary embodiment, each of the first extensions is provided with a hollow opening configured to receive an end of the plurality of upper ribs 104. The first extensions are configured to pivotally move downward to move the plurality of upper ribs 104 in the same direction for a non-use configuration.

Similarly, each of the plurality of lower ribs 105 is pivotally connected to a stationary second holder 207 (i.e., hub) attached at the pole 111. The second holder 207 includes a plurality of insertion portions 209 with an equal angular distance therebetween that is configured to receive an end of the lower rib 105. The end of the lower rib 105 that is affixed in the insertion portion 209 can pivotally move via a pin (not shown) inserted through the lower rib 105. As such, this permits the plurality of lower ribs 105 to be fixed to the pole 111 while moving in a downward direction and place the lower ribs 105 in a non-use configuration. The second holder 207 can also include a plurality of second extensions extending outwardly from the respective insertion portions 209. In this exemplary embodiment, each of the second extensions is provided with a hollow opening configured to receive an end of the plurality of the lower ribs 105. The second extensions are configured to pivotally move downward to move the plurality of lower ribs 105 in the same direction for a non-use configuration.

Below the second holder 207, a slideable hub 210 is provided to slidably move along the pole 111. The slideable hub 210 enables the parasol 200 to open and close. For example, to open the parasol 200, a user moves the hub 210 towards the second holder 207, i.e., in an upward direction. The upward motion of the hub 210 pulls the plurality of upper ribs 104 and the plurality of lower ribs 105, in the upward direction as well. To close the parasol 200, the user moves the hub 210 away from the second holder 207, i.e., in a downward direction. The downward motion of the hub 210 pulls the plurality of upper ribs 104 and the plurality of lower ribs 105, in the downward direction.

The rib mechanism 203 includes a stay bar 222 to assist in the raising of the rib mechanism 203, particularly the plurality of upper ribs 104 to achieve the open configuration. The stay bar 222 includes a first end 222*a* connected to a portion of the upper rib 104 and a second end 222*b* connected to the slideable hub 210. The stay bar 222 is also configured to support the plurality of upper ribs 104 and provide stability to the entire parasol 200. In non-use of the parasol 200, when the slideable hub 210 moves in a downward direction to close the parasol 200, the upper ribs 104 pivotally move downwardly concurrently due to the connection of the stay bar 222 attached to the slidable hub 210. In use, when the slideable hub 210 moves in an upward direction to open the parasol 200, the upper ribs 104 pivotally move upwardly concurrently with the slideable hub 210. In some implementations, the stay bar 222 is made from a rigid material, such as, for example, but not limited to, metal and/or plastic, to support the plurality of upper ribs 104. In some implementations, the stay bar 222 can be made from the same material as the rib mechanism 203, or can be made from different material as the rib mechanism 203.

Figure 10A:
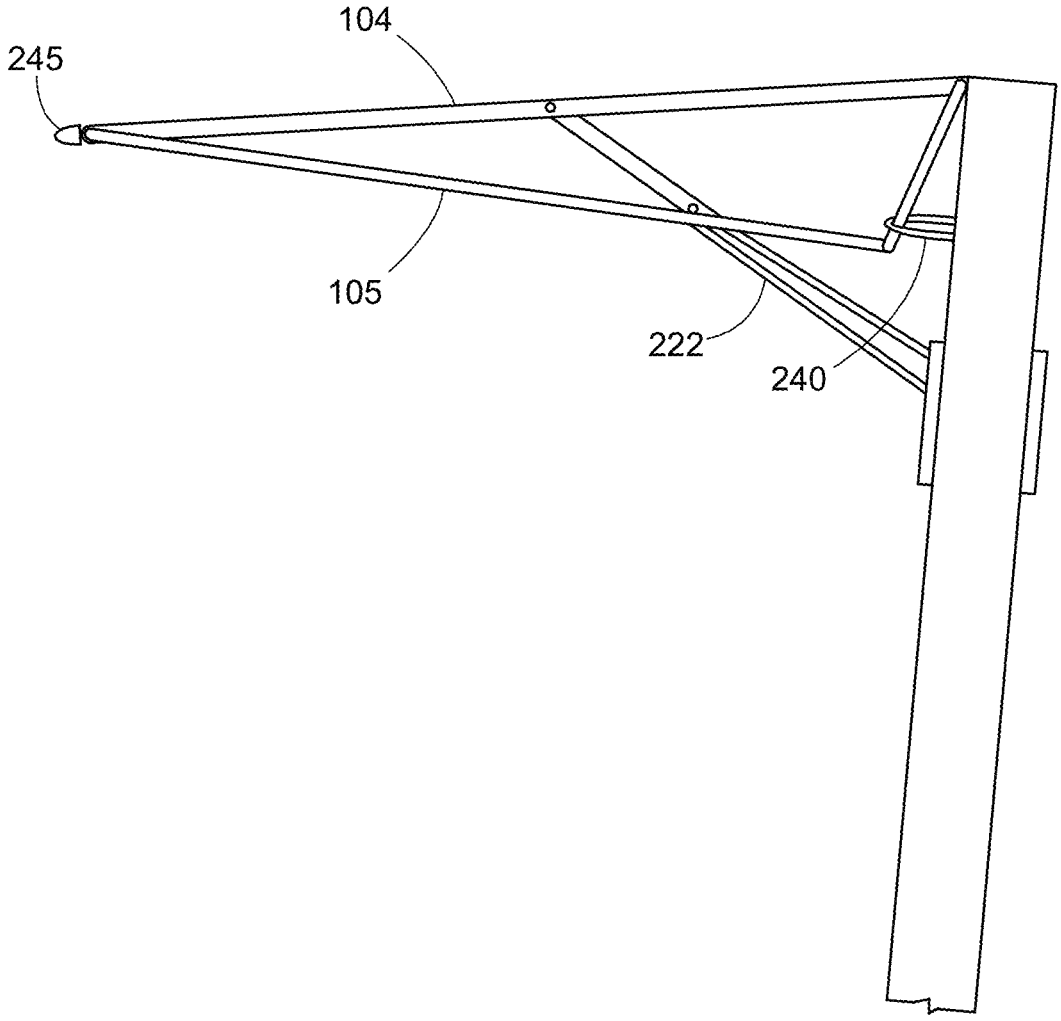
FIG. 10A is a perspective view of the wind resistant parasol at an open position without an upper and lower canopy, according to another example embodiment of the present disclosure.
Figure 10B:
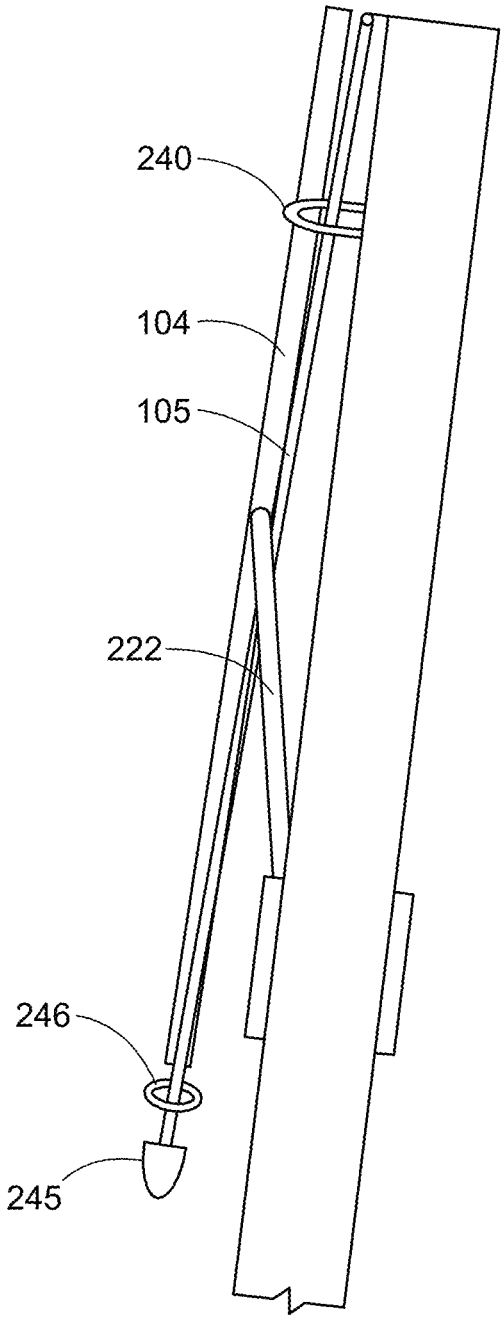
FIG. 10B is a perspective view of the wind resistant parasol at a closed position without an upper and lower canopy, according to another example embodiment of the present disclosure.
Figure 11:
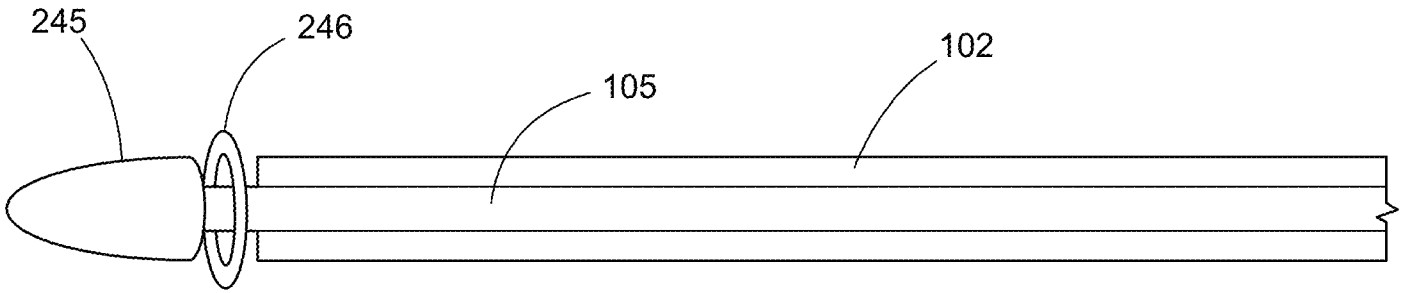
FIG. 11 is a perspective view of a distal end of a lower rib of FIG. 10B, according to an example embodiment of the present disclosure.

Referring to FIGS. 10A and 10B, in an alternative exemplary embodiment, the rib mechanism 203 includes a ring member 240 to stop the stay bar 222 from further movement. That is, the ring member 240 pulls the lower rib 105 down into place during opening of the parasol 200, as shown in FIG. 10A. The ring member 240 is attached to the pole 111 and is provided around the stay bar 222. In one implementation, the ring member 240 is attached to the pole 111 using a clamp, for example. When the parasol 200 is closed (collapsed), the ring member 240 allows the stay bar 222 to come closer to the pole 111, and prevents the stay bar 222 from expanding (i.e., moving away from the pole 111), as shown in FIG. 10B. Further, upon collapsing, an end of the lower rib 105 can extend out of the upper rib 104 due to the longer length of the lower rib 105 according to this example embodiment. In some implementations, a distal end of the lower rib 105 includes a bulleted end 245. In other words, the bulleted end 245 is larger than a hole in end of the upper rib 104 so it cannot pass through when the parasol 200 is in its open configuration, as shown in FIG. 11. In some implementations, a grommet 246 can be used by attaching the grommet 246 into the canopy through which the lower rib 105 can pass when the parasol 200 is collapsed or in a closed configuration. The grommet 246 provides structural integrity and prevents the canopy from tearing. In some implementation, the grommet 246 is sewn into the canopy. In some implementation, the grommet 246 can be made from a metal material.

FIGS. 12A-12D are perspective views of a wind resistant parasol 300 illustrating a rib mechanism that is configured to open/close the parasol, according to another example embodiment of the present disclosure. Like reference numerals will be used in this section and not described further to indicate the presence of a similar or identical element or feature.

Figure 12A:
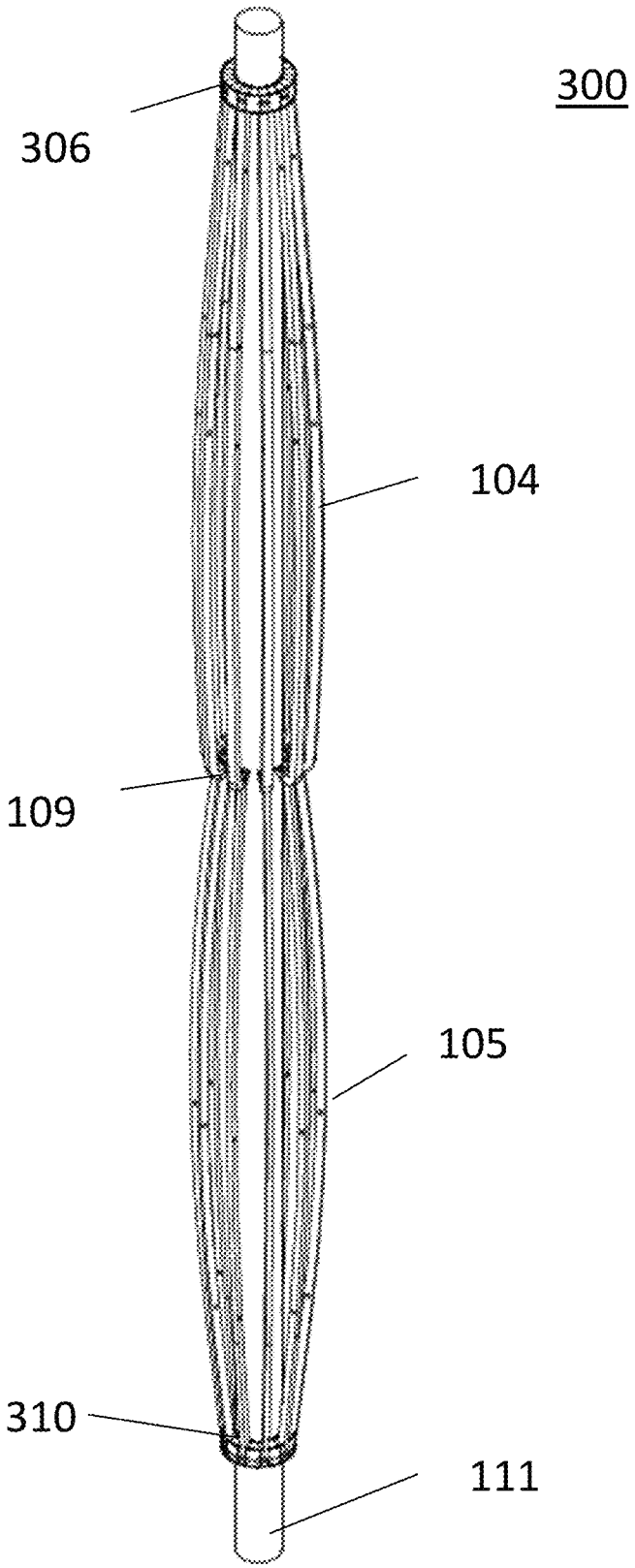
FIGS. 12A and 12B are different perspective views of a wind resistant parasol at a closed position, according to another example embodiment of the present disclosure.
Figure 12B:
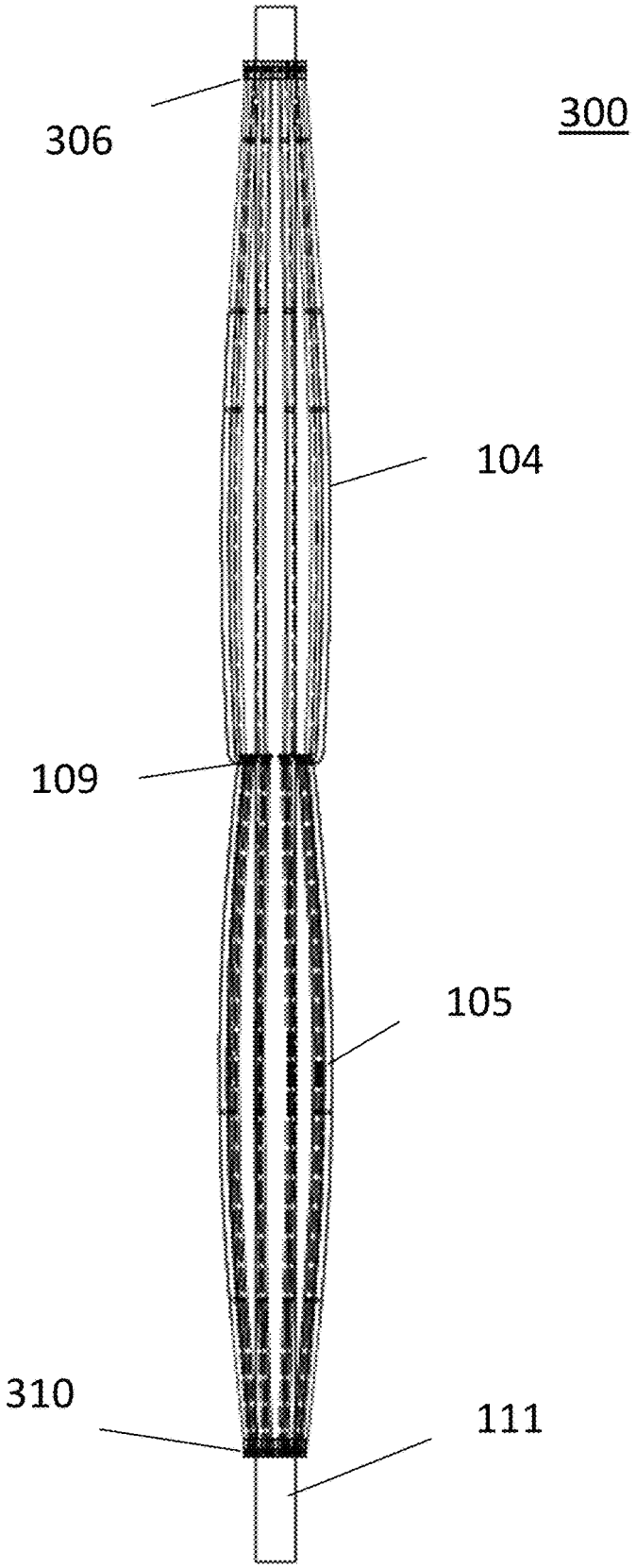
Figure 12C:
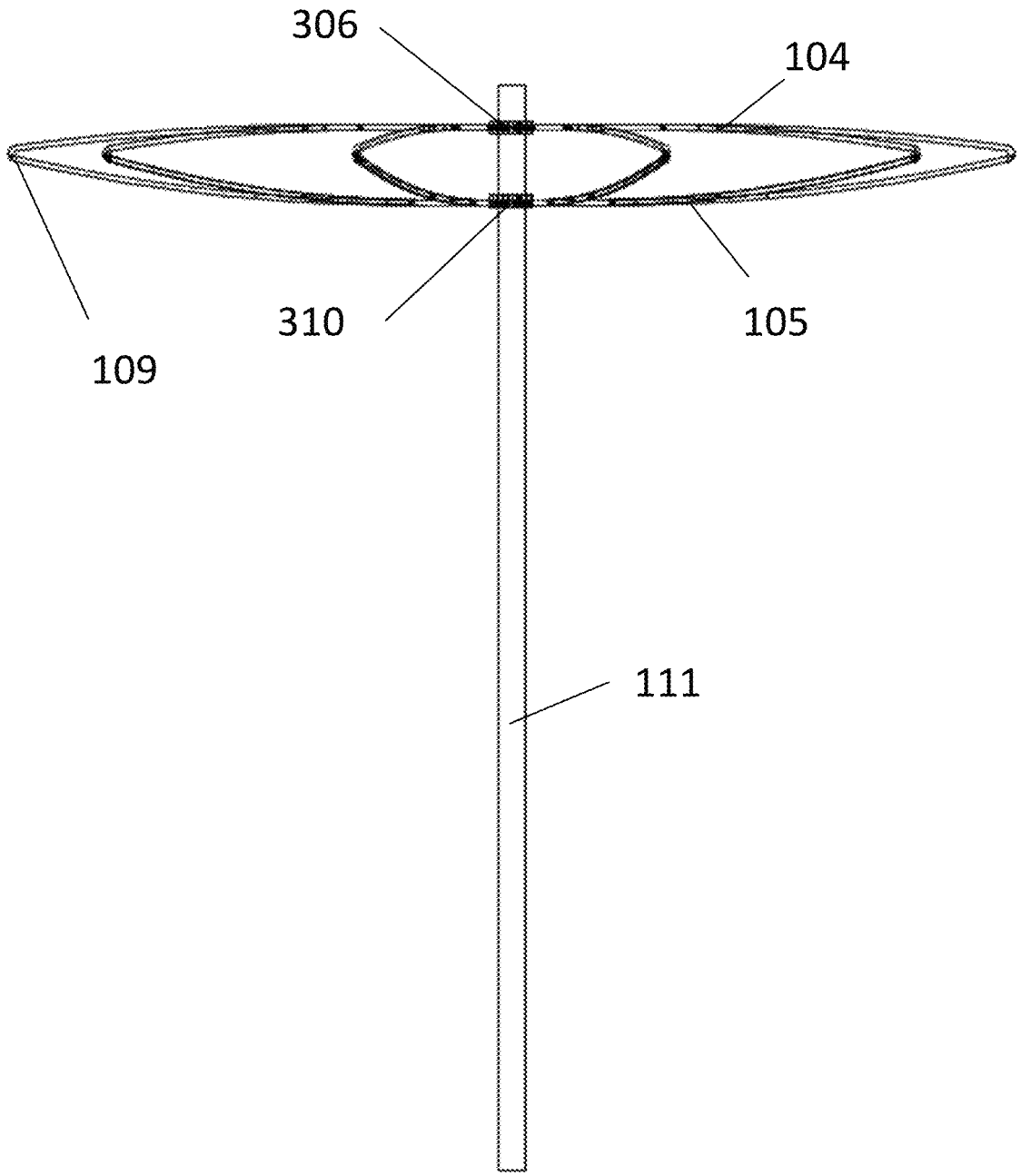
FIGS. 12C and 12D are different perspective views of a wind resistant parasol at an open position, according to another example embodiment of the present disclosure.
Figure 12D:
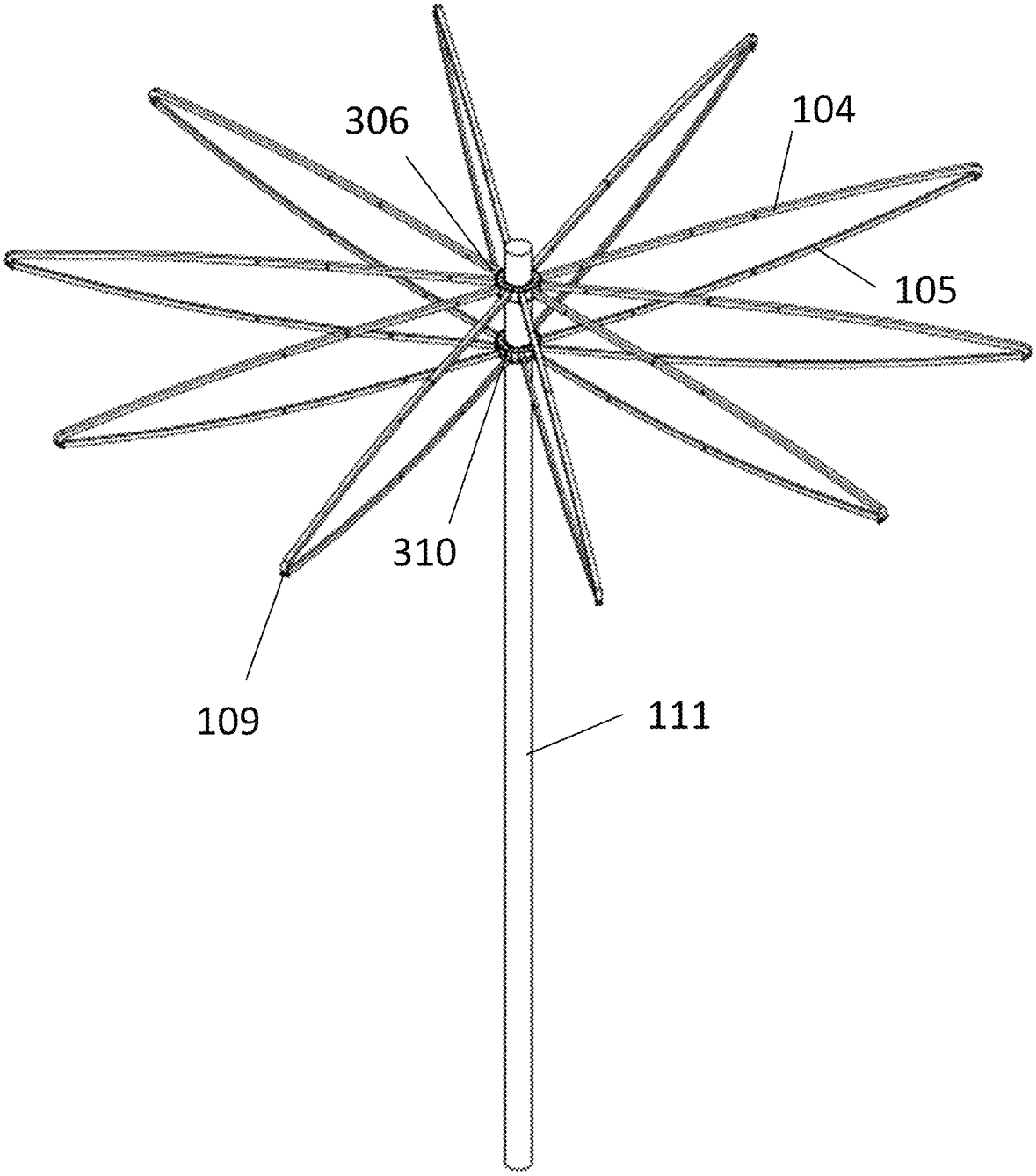

As shown in FIGS. 12A-12D, the wind resistant parasol 300 (depicted without a canopy) includes a two-folded rib mechanism 303 having a plurality of upper ribs 104 and a plurality of lower ribs 105. The plurality of upper ribs 104 and the plurality of lower ribs 105 are connected together by a rib connector 109 forming a closed loop. The rib connector 109 is located near a pole 111 when in its closed configuration, as shown in FIGS. 12A and 12B; and located distally from the pole 111 when in its open configuration, as shown in FIGS. 12C and 12D. Similar to exemplary parasols 100 and 200 discussed above, parasol 300 also has an upside-down (i.e., inverted, reversed, flip-flopped) configuration where a profile of the upper ribs 104 is substantially straight and a profile of the lower ribs 105 is curved (i.e., convex shaped) to guide the wind towards the ground and produce downward lift force.

Figure 13A:
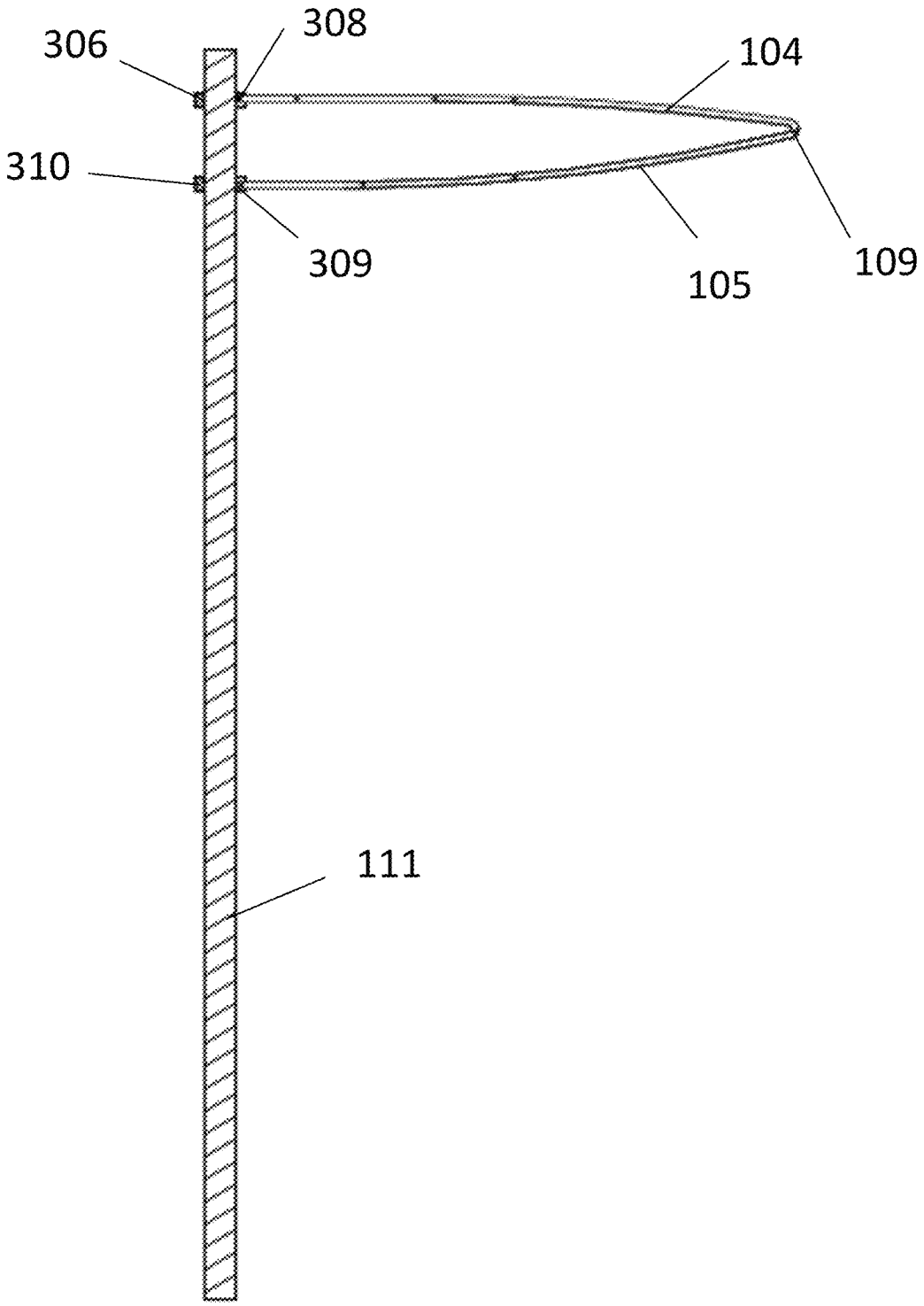
FIG. 13A is a perspective view of the wind resistant parasol at an open position without an upper and lower canopy, according to an example embodiment of the present disclosure.
Figure 13B:
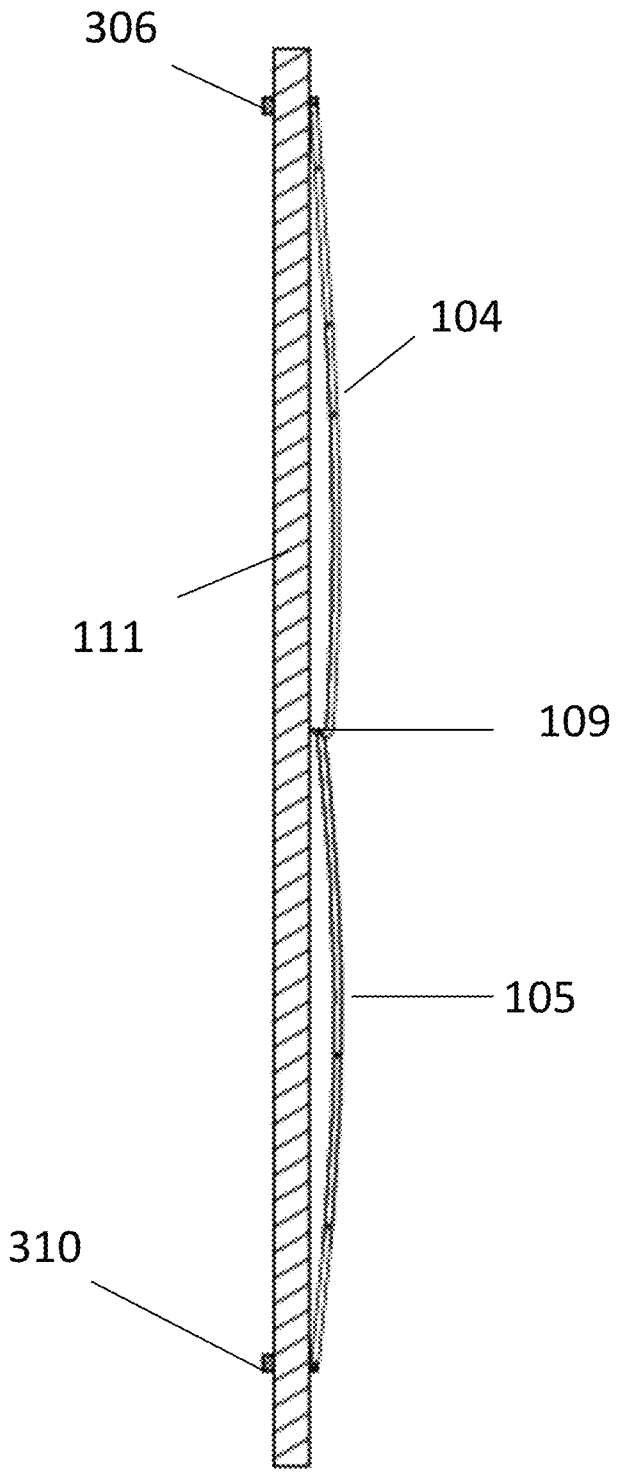
FIG. 13B is a perspective view of the wind resistant parasol at a closed position without an upper and lower canopy, according to an example embodiment of the present disclosure.

Each of the plurality of upper ribs 104 is pivotally connected to a stationary first holder 306 (i.e., hub) attached at the pole 111. The first holder 306 includes a plurality of insertion portions 308 with an equal angular distance therebetween that is configured to receive an end of the upper rib 104, as shown in FIGS. 13A and 13B. The end of the upper rib 104 that is affixed in the insertion portion 308 can pivotally move via a pin (not shown) inserted through the upper rib 104. As such, this permits the plurality of upper ribs 104 to be fixed to the pole 111 while moving in a downward direction and place the upper ribs 104 in a non-use configuration, as shown in FIGS. 12A and 12B. In other implementations, the first holder 306 can include a plurality of extensions extending outwardly from the respective insertion portions 308. In this exemplary embodiment, each of the plurality of extensions is provided with a hollow opening configured to receive an end of the plurality of upper ribs 104. The plurality of extensions is configured to pivotally move downward to move the plurality of upper ribs 104 in the same direction for a non-use configuration.

Below the stationary first holder 306, a slideable second holder 310 is provided to slidably move along the pole 111. The slideable second holder 310 enables the parasol 300 to open and close. For example, to open the parasol 300, a user moves the slideable second holder 310 towards the first holder 306, i.e., in an upward direction. The upward motion of the slideable second holder 310 pulls the plurality of upper ribs 104 and the plurality of lower ribs 105, in the upward direction as well. To close the parasol 300, the user moves the slideable second holder 310 away from the first holder 306, i.e., in a downward direction. The downward motion of the slideable second holder 310 pulls the plurality of upper ribs 104 and the plurality of lower ribs 105 in the downward direction, closing the parasol 300.

The second holder 310 includes a plurality of insertion portions 309 with an equal angular distance therebetween that is configured to receive an end of the lower rib 105, as shown in FIGS. 13A and 13B. The end of the lower rib 105 that is affixed in the insertion portion 309 can pivotally move via a pin (not shown) inserted through the lower rib 105. In other implementations, the second holder 310 can include a plurality of extensions extending outwardly from the respective insertion portions 309. In this exemplary embodiment, each of the plurality of extensions is provided with a hollow opening configured to receive an end of the plurality of lower ribs 105. The plurality of extensions is configured to pivotally move downward to move the plurality of lower rib 105 in the same direction for a non-use configuration.

Example embodiments provide an advantage of providing a wind resistant parasol that reduces the turning probability (i.e., inversion) of the parasol. The parasol disclosed herein provides an improved wind-guided performance. Unlike traditionally available parasols, the proposed parasol is designed to embody a lower canopy beside an upper canopy, where the lower canopy helps in releasing air pressure below the parasol's canopy while effectively shedding rain, snow, sunlight, etc.

In some implementations, an air deflecting device, such as a spoiler (not shown) may be used to alter the aerodynamic performance of the parasol. That is, a spoiler creates turbulence by disturbing or "spoiling" airflow along a surface, thereby shifting the center of lift. In some implementations, the spoiler can be a device surface that is attached to the upper canopy and/or the lower canopy at an inclination different from that of the respective canopy surfaces. The spoiler may be integrated as a seamless part of the canopy, but exists substantially on the surface of the canopy such that the canopy surface continues on either side of the spoiler. Alternatively, the spoiler can be a separate part of the upper canopy and/or the lower canopy.

The articles "a" and "an," as used herein, mean one or more when applied to any feature in embodiments of the present disclosure described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used. The adjective "any" means one, some, or all indiscriminately of whatever quantity.

"At least one," as used herein, means one or more and thus includes individual components as well as mixtures/combinations.

The transitional terms "comprising", "consisting essentially of" and "consisting of", when used in the appended claims, in original and amended form, define the claim scope with respect to what unrecited additional claim elements or steps, if any, are excluded from the scope of the claim(s). The term "comprising" is intended to be inclusive or open-ended and does not exclude any additional, unrecited element, method, step or material. The term "consisting of" excludes any element, step or material other than those specified in the claim and, in the latter instance, impurities ordinarily associated with the specified material(s). The term "consisting essentially of" limits the scope of a claim to the specified elements, steps or material(s) and those that do not materially affect the basic and novel characteristic(s) of the claimed disclosure. All materials and methods described herein that embody the present disclosure can, in alternate embodiments, be more specifically defined by any of the transitional terms "comprising," "consisting essentially of," and "consisting of."

Although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that, if an element is referred to as being "connected" or "coupled" to another element, it can be directly connected, or coupled, to the other element or intervening elements may be present. In contrast, if an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

Spatially relative terms (e.g., "beneath," "below," "lower," "above," "upper" and the like) may be used herein for ease of description to describe one element or a relationship between a feature and another element or feature as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, for example, the term "below" can encompass both an orientation that is above, as well as, below. The device may be otherwise oriented (rotated 90 degrees or viewed or referenced at other orientations) and the spatially relative descriptors used herein should be interpreted accordingly.

Example embodiments are described herein with reference to cross-sectional illustrations that are schematic illustrations of idealized embodiments (and intermediate structures). As such, variations from the shapes of the illustrations as a result, for example, of manufacturing techniques and/or tolerances, may be expected. Thus, example embodiments should not be construed as limited to the particular shapes of regions illustrated herein but may include deviations in shapes that result, for example, from manufacturing.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

While the disclosure has been described with reference to a preferred embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. A wind resistant parasol, comprising:

a pole; and a rib mechanism attached to the pole, the rib mechanism including:

a plurality of upper ribs configured to support an upper canopy;

a plurality of lower ribs configured to support a lower canopy; and a rib connector connecting the plurality of upper ribs and the plurality of lower ribs together to form a closed loop, wherein, when the parasol is open, the upper canopy has a substantially flat profile and the lower canopy has a curved profile formed by the respective plurality of upper ribs and plurality of lower ribs, wherein the lower canopy is configured to guide air pressure in a downward direction causing the parasol to be stabilized.

2. The wind resistant parasol of claim 1, wherein the rib mechanism further comprises a first holder for holding the plurality of upper ribs and a second holder for holding the plurality of lower ribs, wherein the first holder is fixedly mounted to the pole and the second holder is slideably mounted on the pole.

3. The wind resistance parasol of claim 2, wherein the rib mechanism includes a stopper disposed below the second holder to restrict linear movement of the first holder over the second holder.

4. The wind resistant parasol of claim 3, wherein the plurality of first extensions is pivotally affixed to the first holder via a pin, and configured to pivotally move the plurality of upper ribs in a same direction for an open position.

5. The wind resistant parasol of claim 3, wherein the plurality of second extensions is pivotally affixed to the second holder via a pin, and configured to pivotally move the plurality of lower ribs in a same direction for an open position.

6. The wind resistant parasol of claim 3, wherein the first holder includes a plurality of grooves to securely hold the plurality first extensions in the first holder.

7. The wind resistant parasol of claim 3, wherein the second holder includes a plurality of grooves to securely hold the plurality second extensions in the second holder.

8. The wind resistant parasol of claim 2, wherein:

the first holder includes a plurality of first extensions with an equal angular distance therebetween, the plurality of first extensions includes a hollow opening configured to receive an end of the plurality of upper ribs; and the second holder includes a plurality of second extensions with an equal angular distance therebetween, the plurality of second extensions includes a hollow opening configured to receive an end of the plurality of lower ribs.

9. The wind resistant parasol of claim 2, further comprising a tilting mechanism for adjusting an angle of the upper canopy and the lower canopy, wherein the tilting mechanism is attached between a top end portion of the pole and the second holder.

10. The wind resistant parasol of claim 1, further comprising an auger at a bottom end portion of the pole for fixing the parasol to a ground.

11. The wind resistant parasol of claim 10, further comprising a torque handler to move the auger towards the ground.

12. The wind resistant parasol of claim 1, further comprising a height adjusting mechanism to adjust a required height of the parasol, the height adjusting mechanism includes a first arm portion and a second arm portion that are telescoping with respect to each other, wherein an outer diameter of the first arm portion is smaller than an inner diameter of the second arm portion such that the first arm portion is slidable inside the second arm portion.

13. A wind resistant parasol, comprising:

a pole;

an upper canopy;

a lower canopy attached to the upper canopy; and a rib mechanism including a plurality of upper ribs to support the upper canopy and a plurality of lower ribs to support the lower canopy, wherein the upper canopy and the lower canopy are configured over the plurality of upper ribs and the plurality of lower ribs, respectively, forming a hollow airfoil, wherein the lower canopy has a convex shape such that an inner facing portion of the lower canopy is directed upwards which guides air pressure in a downward direction and forces the parasol towards a ground, and wherein the plurality of upper ribs is connected to the plurality of lower ribs by a rib connector, the rib connector includes a first arm portion connecting one end of the upper ribs and a second arm portion connecting one end of the lower ribs.

14. The wind resistant parasol of claim 13, wherein the pole includes a first holder fixedly mounted to the pole and a second holder slidably mounted to the pole, the second holder linearly moves on the pole to open or close the parasol.

15. The wind resistant parasol of claim 14, wherein each of the plurality of upper ribs has a first end connected to the first holder and a second end connected to the rib connector and each of the plurality of lower ribs has a first end connected to the second holder and a second end connected to the rib connector, forming a closed loop.

16. The wind resistant parasol of claim 14, wherein the first holder includes a plurality of receiving portions being of a hollow opening to receive each of the plurality of the upper ribs, and the second holder includes a plurality of receiving portions being of a hollow opening to receive each of the plurality of the lower ribs.

17. The wind resistant parasol of claim 14, further comprising a stay bar having a first end attached to a portion of the upper rib and a second end attached to the second holder.

18. The wind resistant parasol of claim 17, wherein the stay bar pulls at least one of the upper rib or the lower rib to open or close the parasol.

19. The wind resistant parasol of claim 17, further comprising a ring member to prevent the stay bar from further movement and to pull the lower rib down into place during opening of the parasol.

* * * * *